US011739991B2

(12) United States Patent
Zhang et al.

(10) Patent No.: US 11,739,991 B2
(45) Date of Patent: Aug. 29, 2023

(54) AIR CONDITIONING SYSTEM AND CONTROL METHOD FOR AIR CONDITIONING SYSTEM

(71) Applicants: GREE ELECTRIC APPLIANCES (WUHAN) CO., LTD, Wuhan (CN); GREE ELECTRIC APPLIANCES, INC. OF ZHUHAI, Zhuhai (CN)

(72) Inventors: Shiqiang Zhang, Zhuhai (CN); Lianfa Wu, Zhuhai (CN); Limin Li, Zhuhai (CN); Huachao Jiao, Zhuhai (CN); Bing Zhou, Zhuhai (CN); Peng Cao, Zhuhai (CN); Tao Feng, Zhuhai (CN)

(73) Assignees: GREE ELECTRIC APPLIANCES (WUHAN) CO., LTD, Wuhan (CN); GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 136 days.

(21) Appl. No.: 17/046,291

(22) PCT Filed: Aug. 28, 2018

(86) PCT No.: PCT/CN2018/102711
§ 371 (c)(1),
(2) Date: Oct. 8, 2020

(87) PCT Pub. No.: WO2019/196311
PCT Pub. Date: Oct. 17, 2019

(65) Prior Publication Data

US 2021/0080137 A1 Mar. 18, 2021

(30) Foreign Application Priority Data

Apr. 9, 2018 (CN) ..... 201810312592.9

(51) Int. Cl.
*F25B 13/00* (2006.01)
*F24F 11/84* (2018.01)
(Continued)

(52) U.S. Cl.
CPC ..... *F25B 13/00* (2013.01); *F24F 1/0068* (2019.02); *F24F 1/32* (2013.01); *F24F 1/48* (2013.01);
(Continued)

(58) Field of Classification Search
CPC ..... F24F 11/30; F24F 1/48; F24F 2140/00; F24F 11/84; F24F 1/0068; F24F 11/86;
(Continued)

(56) References Cited

U.S. PATENT DOCUMENTS

2016/0273795 A1* 9/2016 Takenaka ..... F25B 47/022
2020/0182516 A1* 6/2020 Maruyama ..... F25B 49/02

FOREIGN PATENT DOCUMENTS

CN 104197432 A 12/2014
CN 106052181 A 10/2016
(Continued)

*Primary Examiner* — Henry T Crenshaw
(74) *Attorney, Agent, or Firm* — Kilpatrick Townsend & Stockton, LLP

(57) ABSTRACT

An air conditioning system, including a compressor, two outdoor heat exchange units, a liquid pipe used for communicating with indoor units, a high-pressure gas tube and a low-pressure gas tube; the air conditioning system further includes a valve assembly. One outdoor heat exchange unit has a first state in which one end thereof communicates with the high-pressure gas tube and another end thereof communicates with the liquid pipe, and has a second state in which one end thereof communicates with the low-pressure gas tube and the other end thereof communicates with the liquid pipe. Further disclosed is a control method for the air conditioning system.

17 Claims, 13 Drawing Sheets

(51) Int. Cl.

| | |
|---|---|
| ***F24F 11/86*** | (2018.01) |
| ***F24F 11/30*** | (2018.01) |
| ***F24F 1/0068*** | (2019.01) |
| ***F24F 1/32*** | (2011.01) |
| ***F24F 1/48*** | (2011.01) |
| ***F25B 29/00*** | (2006.01) |
| ***F25B 49/02*** | (2006.01) |
| ***F25B 41/20*** | (2021.01) |
| ***F24F 140/00*** | (2018.01) |

(52) U.S. Cl.
CPC ..... *F24F 11/30* (2018.01); *F24F 11/84* (2018.01); *F24F 11/86* (2018.01); *F25B 29/003* (2013.01); *F25B 41/20* (2021.01); *F25B 49/02* (2013.01); *F24F 2140/00* (2018.01); *F25B 2313/0231* (2013.01); *F25B 2313/0253* (2013.01); *F25B 2313/02742* (2013.01); *F25B 2600/2501* (2013.01)

(58) Field of Classification Search
CPC ..... F24F 1/32; F25B 2600/25; F25B 41/20; F25B 2313/0253; F25B 2313/02742; F25B 2600/2501; F25B 13/00; F25B 29/003; F25B 49/02; F25B 2313/0231
See application file for complete search history.

(56) References Cited

FOREIGN PATENT DOCUMENTS

| | | | |
|---|---|---|---|
| CN | 107178833 | A | 9/2017 |
| CN | 107796146 | A | 3/2018 |
| JP | H0339870 | A | 2/1991 |
| JP | 2016170541 | A | 6/2006 |
| KR | 101624529 | B1 | 6/2016 |

* cited by examiner

AIR CONDITIONING SYSTEM AND CONTROL METHOD FOR AIR CONDITIONING SYSTEM

CROSS REFERENCE TO RELATED APPLICATIONS

This application claims all benefits accruing under 35 U.S.C. § 119 from China Patent Application No. 201810312592.9, filed on Apr. 9, 2018 in the China National Intellectual Property Administration, the entire content of which is hereby incorporated by reference. This application is a national phase under 35 U.S.C. § 120 of international patent application PCT/CN2018/102711, entitled "AIR CONDITIONING SYSTEM AND CONTROL METHOD FOR AIR CONDITIONING SYSTEM" filed on Aug. 28, 2018, the content of which is also hereby incorporated by reference.

TECHNICAL FIELD

The present disclosure relates to a technical field of air handing equipment, and more particular, to an air conditioning system and a control method for the air conditioning system.

BACKGROUND

In the global market of multi-connected air conditioning units, heat recovery multi-connected air conditioning units are very popular with consumers in the North American and European Units markets. At present, most outdoor heat exchangers applied in heat recovery are designed to be one-piece, so that when a heat recovery mode (in which both cooling and heating are demanded) is turned on, the one-piece outdoor heat exchanger needs to participate in heat exchange, thus resulting in a mismatch between heat exchange areas of condensation and evaporation in the entire system, causing the indoor air outlet temperature unable to meet customer requirements, and resulting in a very poor experience of "not feeling cool in a cooling room, and not feeling heat in a heating room".

SUMMARY

For solving the above technical problems, an air conditioning system is provided to adjust heat exchange areas of outdoor heat exchange units.

An air conditioning system includes a compressor, two outdoor heat exchange units, a liquid pipe, a high-pressure gas pipe being in communication with an exhaust port of the compressor, a low-pressure gas pipe being in communication with an intake port of the compressor, and a valve assembly; one outdoor heat exchange unit has a first state; in the first state, one end of the one outdoor heat exchange unit is in communication with the high-pressure gas pipe, and another end thereof is in communication with the liquid pipe; the one outdoor heat exchange unit has a second state; in the second state, the one end of the one outdoor heat exchange unit is in communication with the low-pressure gas pipe, and the other end thereof is in communication with the liquid pipe; another outdoor heat exchange unit has a third state; in the third state, one end of the other outdoor heat exchange unit is in communication with the liquid pipe, and another end thereof is in communication with the high-pressure gas pipe via the valve assembly; the other outdoor heat exchange unit has a fourth state; in the fourth state, the one end of the outdoor heat exchange unit is in communication with the liquid pipe, and the other end thereof is in communication with the low-pressure gas pipe via the valve assembly; and the valve assembly controls the other outdoor heat exchange unit to switch between the third state and the fourth state.

In some embodiments, the valve assembly includes a high-pressure solenoid valve and a low-pressure solenoid valve; the high-pressure solenoid valve has one end that forms a high-pressure inlet of the valve assembly, and another end that forms a high-pressure outlet of the valve assembly; the low-pressure solenoid valve has one end being in communication with the high-pressure outlet, and another end that forms a low-pressure outlet of the valve assembly; the high-pressure inlet is directly or indirectly in communication with the exhaust port of the compressor; the high-pressure outlet is in communication with the corresponding outdoor heat exchange unit; and the low-pressure outlet is in communication with the low-pressure gas pipe.

In some embodiments, the valve assembly further includes a low-pressure bypass solenoid valve; the low-pressure bypass solenoid valve has one end being in communication with the high-pressure outlet, and another end being in communication with the low-pressure outlet.

In some embodiments, the high-pressure solenoid valve is a high-pressure two-way valve, and the low-pressure solenoid valve is a low-pressure two-way valve.

In some embodiments, the air conditioning system further includes a cooling four-way valve; a port D of the cooling four-way valve is in communication with the exhaust port of the compressor, a port S of the cooling four-way valve is in communication with the low-pressure gas pipe, a port C of the cooling four-way valve is in communication with the one outdoor heat exchange unit and the high-pressure inlet, respectively; and the high-pressure outlet is in communication with the other outdoor heat exchange unit.

In some embodiments, a port E of the cooling four-way valve is in communication with the intake port of the compressor via a throttling device or is a port E of the cooling four-way valve is disposed to be closed. The port C of the heating four-way valve is in communication with the intake port of the compressor via a throttling device or the port C of the heating four-way valve is arranged to be closed.

In some embodiments, the valve assembly includes a second four-way valve; a port S of the second four-way valve is in communication with the low-pressure gas pipe, a port C of the second four-way valve is in communication with the one outdoor heat exchange unit, and a port D of the second four-way valve is in communication with the high-pressure gas pipe.

In some embodiments, the air conditioning system further includes a first four-way valve, a high-pressure valve, and a low-pressure valve; a port D of the first four-way valve is in communication with the high-pressure gas pipe, a port S of the first four-way valve is in communication with the low-pressure gas pipe, a port C of the first four-way valve is in communication with the port D of the second four-way valve and the other outdoor heat exchange unit, respectively; the high-pressure valve is disposed on the high-pressure gas pipe; and the low-pressure valve has one end being in communication with the high-pressure gas pipe, and another end being in communication with the low-pressure gas pipe.

In some embodiments, the high-pressure valve is a solenoid valve or a two-way valve, and the low-pressure valve is also a solenoid valve or a two-way valve.

In some embodiments, a port E of the second four-way valve is in communication with the intake port of the compressor via a throttling device or a port E of the second four-way valve is arranged to be closed. A port E of the first four-way valve is in communication with the intake port of the compressor via a throttling device, or a port E of the first four-way valve is arranged to be closed.

In some embodiments, the high-pressure inlet and the high-pressure outlet are both in communication with the high-pressure gas pipe. The low-pressure outlet is in communication with the lower-pressure gas pipe.

In some embodiments, the air conditioning system includes heat exchangers. Some of the heat exchangers form the one outdoor heat exchange unit, and remaining heat exchangers form the other outdoor heat exchange unit.

In some embodiments, some heat exchange tubes at a lowest end of each heat exchanger form a defrosting heat exchanger. The defrosting heat exchanger has one end being in communication with the exhaust port of the compressor, and another end being in communication with the low-pressure gas pipe.

In some embodiments, the air conditioning system further includes an Intelligent Power Module (IPM) heat dissipation structure. An inlet and an outlet of the IPM heat dissipation structure are both in communication with the liquid pipe.

In some embodiments, the air conditioning system further includes a supercooling device; the supercooling device is provided with a refrigerant channel and a supercooling channel. Two ends of the refrigerant channel are in communication with the liquid pipe. The supercooling channel has one end that is in communication with the low-pressure gas pipe, and another end that is in communication with an outlet of the supercooling device via a supercooling throttling device. A portion of liquid refrigerant enters the supercooling device through the supercooling throttling device, supercooling refrigerant passing through the refrigerant channel.

In some embodiments, the air conditioning system further includes a liquid reservoir; the liquid reservoir is provided with a high-pressure inlet, a liquid inlet, and a gas outlet; the high-pressure inlet is in communication with the high-pressure gas pipe; the liquid inlet is in communication with the liquid pipe; and the gas outlet is in communication with the low-pressure gas pipe.

In some embodiments, the liquid reservoir further includes a pressure relief branch; the pressure relief branch has one end being in communication with the high-pressure inlet, and another end being in communication with the low-pressure gas pipe via a pressure relief throttling device.

In some embodiments, the low-pressure gas pipe is in communication with a gas supplementing port of the compressor. A portion of gaseous refrigerant enters the compressor from the gas supplementing port of the compressor.

In some embodiments, each outdoor heat exchange unit is in communication with the liquid pipe via an outdoor throttling device.

An air conditioning system includes a compressor, two outdoor heat exchange units, a first four-way valve, a second four-way valve, a liquid pipe, a high-pressure gas pipe, a low-pressure gas pipe, a high-pressure valve, and a low-pressure valve; wherein the high-pressure gas pipe is in communication with an exhaust port of compressor; the low-pressure gas pipe is in communication with an intake port of compressor; a port S of the second four-way valve (10) is in communication with the low-pressure gas pipe; a port C of the second four-way valve is in communication with one outdoor heat exchange unit; a port D of the second four-way valve is in communication with the high-pressure gas pipe; a port D of the first four-way valve is in communication with the high-pressure gas pipe; a port S of the first four-way valve is in communication with the low-pressure gas pipe; a port C of the first four-way valve is in communication with the port D of the second four-way valve and another outdoor heat exchange unit, respectively; the high-pressure valve is disposed on the high-pressure gas pipe; and the low-pressure valve has one end being in communication with the high-pressure gas pipe, and another end being in communication with the low-pressure gas pipe.

In some embodiments, a port E of the second four-way valve is in communication with the intake port of the compressor via a throttling device or a port E of the second four-way valve is arranged to be closed. A port E of the first four-way valve is in communication with the intake port of the compressor via a throttling device or a port E of the first four-way valve is arranged to be closed.

In some embodiments, the air conditioning system further includes a plurality of indoor units provided in parallel; each indoor unit has a fifth state; in the fifth state, one end of the indoor unit is in communication with the liquid pipe (3), and another end thereof is in communication with the high-pressure gas pipe; each indoor unit has a sixth state; in the sixth state, the one end of the indoor unit is in communication with the liquid pipe, and the other end thereof is in communication with the low-pressure gas pipe; each outdoor heat exchange unit is in communication with the liquid pipe via an outdoor throttling device.

In some embodiments, each indoor unit is in communication with the high-pressure gas pipe via a first solenoid valve, and in communication with the low-pressure gas pipe via a second solenoid valve.

A control method for the air conditioning system, including:

a full cooling mode, in which: a port D and a port C of a cooling four-way valve communicate; a port D and a port E of the heating four-way valve communicate; a high-pressure solenoid valve, two outdoor throttling devices, and each second solenoid valve are opened; a low-pressure solenoid valve and each first solenoid valve are closed; most of exhaust gas from the compressor flows through the outdoor heat exchange units, the liquid pipe, the indoor units, and the low-pressure gas pipe sequentially, and flows back to the compressor; and a small portion of the exhaust gas from the compressor enters the indoor units via the high-pressure gas pipe;

a full heating mode, in which: the port D and a port E of the cooling four-way valve communicate; the port D and the port E of the heating four-way valve communicate; the high-pressure solenoid valve and the each second solenoid valve are closed; the low-pressure solenoid valve, the two outdoor throttling devices, and the each first solenoid valve are opened; and the exhaust gas from the compressor flows through the high-pressure gas pipe, the indoor units, the liquid pipe, the outdoor heat exchange unit and the low-pressure gas pipe sequentially, and flows back to the compressor;

a full heat recovery mode, in which: the port D and the port E of the cooling four-way valve communicate; the port D and the port E of the heating four-way valve communicate; the high-pressure solenoid valve and the two outdoor throttling devices are closed; the low-pressure solenoid valve is opened; the first solenoid valve of each of the indoor units in a cooling mode is closed, and the second solenoid valve thereof is opened; the first solenoid valve of each of the indoor units in a heating mode is opened, and the second solenoid valve thereof is closed; the exhaust gas from the compressor flows through the high-pressure gas pipe, the indoor units in the heating mode, the indoor units in the cooling mode, and the low-pressure gas pipe sequentially, and flows back to the compressor;

a main cooling mode, in which: the port D and the port C of the cooling four-way valve communicate; the port D and the port E of the heating four-way valve communicate; the high-pressure solenoid valve, and the outdoor throttling device of the outdoor heat exchange unit that is in communication with the cooling four-way valve are opened; the low-pressure solenoid valve and the outdoor throttling device of the outdoor heat exchange unit that is in communication with the high-pressure outlet are closed; the first solenoid valve of each of the indoor units in the cooling mode is closed, and the second solenoid valve thereof is opened; the first solenoid valve of each of the indoor units in the heating mode is opened, and the second solenoid valve thereof is closed; most of the exhaust gas from the compressor flows through a first outdoor heat exchange unit, the liquid pipe, and the indoor units in the cooling mode, and the low-pressure gas pipe sequentially, and flows back to the compressor; and another portion of the exhaust gas from the compressor flows through the high-pressure gas pipe, the indoor units in the heating mode, the liquid pipe, the indoor unit in the cooling mode, and the low-pressure gas pipe sequentially, and flows back to the compressor;

a main heating mode, in which: the port D and the port E of the cooling four-way valve communicate; the port D and the port E of the heating four-way valve communicate; the high-pressure solenoid valve, and the outdoor throttling device of the outdoor heat exchange unit that is in communication with the high-pressure outlet are closed; the low-pressure solenoid valve and the outdoor throttling device of the outdoor heat exchange unit that is in communication with the cooling four-way valve, are opened; the first solenoid valve of each of the indoor units in the cooling mode is closed, and the second solenoid valve thereof is opened; the first solenoid valve of each of the indoor units in the heating mode is opened, and the second solenoid valve thereof is closed; the exhaust gas from the compressor enters the indoor units in the heating mode via the high-pressure gas pipe and is condensed; after being condensed, a portion of the exhaust gas from the compressor flows through the indoor unit in the cooling mode and the low-pressure gas pipe sequentially, and flows back to the compressor; after being condensed, another portion of the condensed exhaust gas from the compressor flows through the liquid pipe, the first outdoor heat exchange unit and the low-pressure gas pipe sequentially, and flows back to the compressor.

In some embodiments, the air-conditioning system includes a low-pressure bypass solenoid valve; in the full cooling mode, the full heating mode, the full heat recovery mode, the main cooling mode, or the main heating mode, an on/off state of the low-pressure bypass solenoid valve is a same as an on/off state of the low-pressure solenoid valve.

In some embodiments, the outdoor heat exchange unit that is in communication with the high-pressure outlet is an auxiliary heat exchanger, and the control method further includes:

switching the auxiliary heat exchanger from a cooling state to a non-operating state, including: after a time period t1 from a time when a switching command is received, the high-pressure solenoid valve being closed; after a time period t2 from a time when the high-pressure solenoid valve is closed, the outdoor throttling device of the auxiliary heat exchanger being closed; after a time period t3 from a time when the outdoor throttling device is closed, the low-pressure bypass solenoid valve being opened; after a time period t4 from a time when the low-pressure bypass solenoid valve is opened, the low-pressure solenoid valve being opened;

switching the auxiliary heat exchanger from the non-operating state to the cooling state, including: after a time period t5 from a time when a switching command is received, the low-pressure bypass solenoid valve and the low-pressure solenoid valve being closed; after a time period t6 from a time when the low-pressure solenoid valve is closed, the outdoor throttling device of the auxiliary heat exchanger being opened to a maximum opening; after a time t7 from a time when the outdoor throttling device is opened to the maximum opening, the high-pressure solenoid valve being opened;

switching the auxiliary heat exchanger from the heating state to the non-operating state, including: after an time period t8 from a time when a switching command is received, the outdoor throttling device of the auxiliary heat exchanger is closed;

switching the auxiliary heat exchanger from the non-operating state to the heating state, including: after a time period t9 from a time when a switching command is received, the outdoor throttling device of the auxiliary heat exchanger being opened to the maximum opening;

switching the auxiliary heat exchanger from the cooling state to the heating state, including: after the time period t1 from the time when the switching command is received, the high-pressure solenoid valve being closed; after the time period t2 from the time when the high-pressure solenoid valve is closed, the outdoor throttling device of the auxiliary heat exchanger being closed; after the time period t3 from the time when the outdoor throttling device is closed, the low-pressure bypass solenoid valve being opened; after the time period t4 from the time when the low-pressure bypass solenoid valve is opened, the low-pressure solenoid valve being opened; after the time period t9 from the time when the low-pressure solenoid valve is opened, the outdoor throttling device of the auxiliary heat exchanger being opened to the maximum opening;

switching the auxiliary heat exchanger from the heating state to the cooling state: after the eighth time period t8 from the time when a switching command is received, the outdoor throttling device of the auxiliary heat exchanger is closed; after the time period t5 from the time when the outdoor throttling device is closed, the low-pressure bypass solenoid valve and the low-pressure solenoid valve are closed; after the time period t6 from the time when the low-pressure solenoid valve is closed, the outdoor throttling device of the auxiliary heat exchanger is opened to the maximum opening; after the time period t7 from the time when the outdoor throttling device is opened to the maximum opening, the high-pressure solenoid valve is opened.

A control method for the air conditioning system above, including:

a full cooling mode, in which: a port D and a port C of the first four-way valve communicate, a port D and a port C of the second four-way valve communicate; a high-pressure valve, two outdoor throttling devices, and each second solenoid valve are opened; a low-pressure valve and each first solenoid valve are closed;

a full heating mode, in which: the port D and the port E of the first four-way valve communicate; the port D and the port E of the second four-way valve communicate; the high-pressure valve, each first solenoid valve, and the two outdoor throttling devices are opened; the low-pressure valve and each second solenoid valve are closed;

a full heat recovery mode, in which: the port D and the port E of the first four-way valve communicate; the port D and the port E of the second four-way valve communicate; the high-pressure valve is opened; the low-pressure valve and the two outdoor throttling devices are closed; the first solenoid valve of each of the indoor units in a cooling mode is closed, and the second solenoid valve thereof is opened; the first solenoid valve of each of the indoor units in a heating mode is opened, and the second solenoid valve thereof is closed;

a main cooling mode, in which: the port D and the port C of the first four-way valve communicate; the port D and the port C of the second four-way valve communicate; the low-pressure valve and the two outdoor throttling devices are opened; the high-pressure valve is closed; the first solenoid valve of each of the indoor units in the cooling mode is closed, and the second solenoid valve thereof is opened; the first solenoid valve of each of the indoor units in the heating mode is opened, and the second solenoid valve thereof is closed; or in which: the port D and the port C of the first four-way valve communicate, and the port D and the port C of the second four-way valve communicate; the high-pressure valve and one outdoor throttling device are opened, and another outdoor throttling device and the low-pressure valve are closed; the first solenoid valve of each of the indoor units in the cooling mode is closed, and the second solenoid valve thereof is opened; the first solenoid valve of each of the indoor units in the heating mode is opened, and the second solenoid valve thereof is closed;

a main heating mode, in which: the port D and the port E of the first four-way valve communicate; the port D and the port E of the second four-way valve communicate; the high-pressure valve and the two outdoor throttling devices are opened; the low-pressure valve is closed; the first solenoid valve of each of the indoor units in the cooling mode is closed, and the second solenoid valve thereof is opened; the first solenoid valve of each of the indoor units in the heating mode is opened, and the second solenoid valve thereof is closed; or in which: the port D and the port E of the first four-way valve communicate; the port D and the port E of the second four-way valve communicate; the high-pressure valve and the one outdoor throttling device are opened; the other outdoor throttling device and the low-pressure valve are closed; the first solenoid valve of each of the indoor units in the cooling mode is closed, and the second solenoid valve thereof is opened; the first solenoid valve of each of the indoor units in the heating mode is opened, and the second solenoid valve thereof is closed.

In some embodiments, the air conditioning system includes a low-pressure bypass valve; in the full cooling mode, the full heating mode, the full heat recovery mode, the main cooling mode, or the main heating mode, an on/off state of the low-pressure bypass valve is a same as an on/off state of the low-pressure valve.

In the air conditioning system provided by the embodiments of the present disclosure, the outdoor heat exchange units have two portions. When the plurality of indoor units are in the cooling mode and the heating mode at the same time, it is ensured that the indoor units in the cooling mode and the indoor units in the heating mode are provided with matched heat exchange areas for condensation and evaporation respectively, thus enabling the air conditioning system to adjust according to a proportion of demands. Moreover, the ratio between the heat exchange areas of the two outdoor heat exchange units, and the high pressure and the low pressure of the system can also be adjusted, thereby increasing the comfort. By providing the valve assembly to adjust the operating mode of the corresponding outdoor heat exchange unit, the operating modes can be switched under the condition that the frequency of the compressor is not reduced, thereby increasing the flexibility of the mode switching of the air conditioning system, ensuring the stability of the temperature of the blown air. In addition, the noise generated by switching the main valve body during the mode switching can also be reduced.

DETAILED DESCRIPTION OF THE EMBODIMENTS

Figure 1:
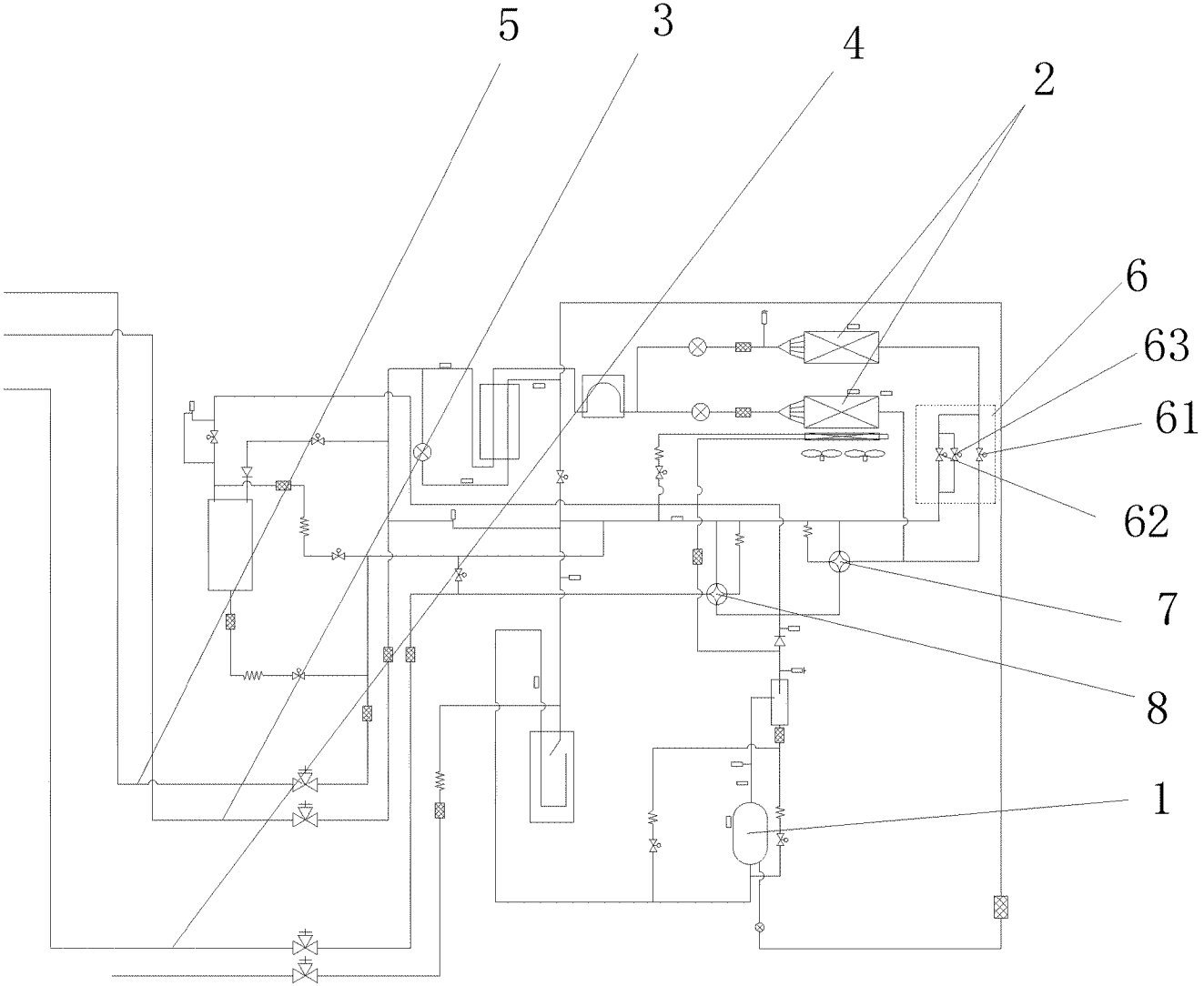
FIG. 1 is a structural schematic view showing an air conditioning system of the present disclosure.
Figure 2:
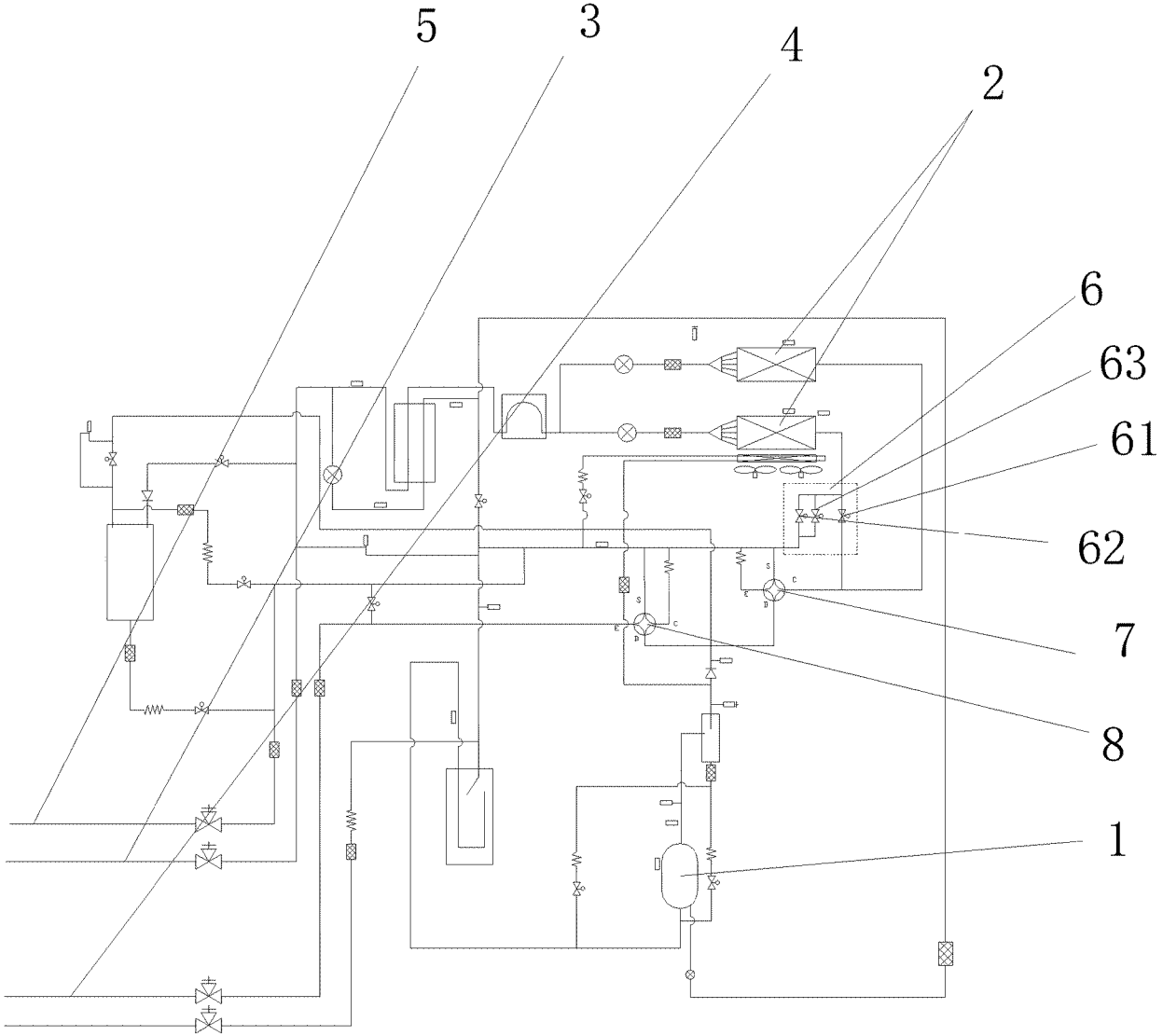
FIG. 2 is a structural schematic view showing another air conditioning system of the present disclosure.
Figure 3:
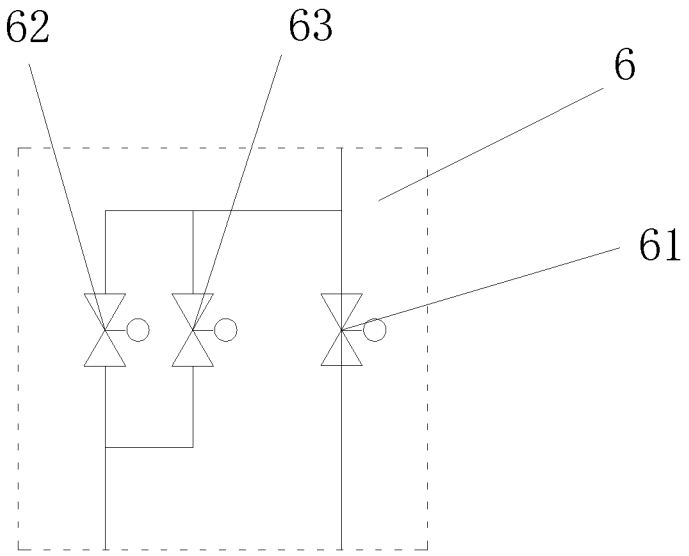
FIG. 3 is a structural schematic view showing another air conditioning system of the present disclosure.

In order to make technical solutions, and advantages of the present disclosure clearer and understood, the present disclosure is further described in detail below with reference to the accompanying drawings and embodiments. It should be understood that the specific embodiments described herein are only used to explain the present disclosure, but not to limit the present disclosure.

The air conditioning system shown in FIGS. 1 to 6 includes a compressor 1, two outdoor heat exchange units 2, a liquid pipe 3, a high-pressure gas pipe 4, and a low-pressure gas pipe 5. The high-pressure gas pipe 4 is in communication with an exhaust port of the compressor 1. The low-pressure gas pipe 5 is in communication with an intake port of the compressor 1. The air conditioning system further includes a valve assembly 6. One outdoor heat exchange unit 2 has a first state, in which one end 21 thereof is in communication with the high-pressure gas pipe 4, and the other end 22 thereof is in communication with the liquid pipe 3; and the one outdoor heat exchange unit 2 has a second state, in which one end 21 thereof is in communication with the low-pressure gas pipe 5, and the other end 22 thereof is in communication with the liquid pipe 3. The other outdoor heat exchange unit 2 has a third state, in which one end 22' thereof is in communication with the liquid pipe 3, and the other end 21' thereof is in communication with the high-pressure gas pipe 4 via the valve assembly 6; and the other outdoor heat exchange unit 2 has a fourth state in which one end 22' thereof is in communication with the liquid pipe 3, and the other end 21' thereof is in communication with the low-pressure gas pipe 5 via the valve assembly. The valve assembly 6 controls the outdoor heat exchange unit 2 to switch between the third state and the fourth state. By using two outdoor heat exchange units 2 and adjusting the operating state of the two outdoor heat exchange units 2 according to the requirements of an indoor unit 11, it can be ensured that the heat exchange areas of condensation and evaporation match the requirements of the indoor unit 11, thereby increasing the comfort of the system. In addition, the operating state of the corresponding outdoor heat exchange unit can be adjusted by the valve assembly 6. That is, the outdoor heat exchange unit can be adjusted to be in any one of the following three states: a condensation state in which the outdoor heat exchange unit is in communication with the high-pressure gas pipe 4, an evaporation state in which the outdoor heat exchange unit is in communication with the low-pressure gas pipe 5, and a non-working state in which the outdoor heat exchange unit is not in communication with the high-pressure gas pipe 4 and the low-pressure gas pipe 5, so that the operating state of the air conditioning system is switched without reducing the frequency of the compressor 1, which can effectively reduce the noise generated by a main valve body in a switching process.

In some embodiments, the two outdoor heat exchange units are the upper and lower parts of a heat exchanger.

The valve assembly 6 includes a high-pressure solenoid valve 61 and a low-pressure solenoid valve 62. The high-pressure solenoid valve 61 has one end 611 that forms a high-pressure inlet of the valve assembly 6, and another end 612 that forms a high-pressure outlet of the valve assembly 6. The low-pressure solenoid valve 62 has one end 621 that is in communication with the high-pressure outlet, and another end 622 that forms a low-pressure outlet of the valve assembly 6. The high-pressure inlet is directly or indirectly in communication with the exhaust port of the compressor 1. The high-pressure outlet is in communication with the corresponding outdoor heat exchange unit 2. The low-pressure outlet is in communication with the low-pressure gas pipe 5. The pressure value of the corresponding outdoor heat exchange unit 2 is quickly adjusted by the high-pressure solenoid valve 61 and the low-pressure solenoid valve 62, so as to reduce the pressure value that the main valve body needs to overcome during switching, thus there is no need for the compressor to operate at a reduced frequency, thereby ensuring that excessive noise will not be generated during the switching of the main valve body.

The valve assembly 6 further includes a low-pressure bypass solenoid valve 63. The low-pressure bypass solenoid valve 63 has one end 631 that is in communication with the high-pressure outlet, and another end 632 that is in communication with the low-pressure outlet. By providing the low-pressure bypass solenoid valve 63, the pressure can be gradually relieved, and efficiency of relieving pressure can be increased. Moreover, the success rate of the switching of a four-way valve during the switching is increased, while the reliability of connecting pipes, connecting positions and the similar positions of the air conditioning system are ensured.

The high-pressure solenoid valve 61 is a high-pressure two-way valve, and the low-pressure solenoid valve 62 is a low-pressure two-way valve.

The air conditioning system further includes a cooling four-way valve 7 and a heating four-way valve 8. A port D of the cooling four-way valve 7 and a port D of the heating four-way valve 8 are both in communication with the exhaust port of the compressor 1. A port S and a port C of the heating four-way valve 8 are both in communication with the intake port of the compressor 1, and a port E of the heating four-way valve 8 is in communication with the high-pressure gas pipe 4. A port S of the cooling four-way valve 7 is in communication with the intake port of the compressor 1, and a port C of the cooling four-way valve 7 is in communication with one outdoor heat exchange unit 2 and the high-pressure inlet, respectively. The high-pressure outlet is in communication with the other outdoor heat exchange unit 2. The air conditioning system operates in different modes by controlling the communication states between the cooling four-way valve 7, the heating four-way valve 8, the high-pressure solenoid valve 61, the low-pressure solenoid valve 62, and the low-pressure bypass solenoid valve 63.

A port E of the cooling four-way valve 7 is in communication with the intake port of the compressor 1 via a throttling device, or a port E of the cooling four-way valve 7 is arranged to be closed. The port C of the heating four-way valve 8 is in communication with the intake port of the compressor 1 via a throttling device, or the port C of the heating four-way valve 8 is arranged to be closed. That is, when the port S communicates with the port C of the cooling four-way valve 7, no refrigerant passes through the port E to flow into the intake port of the compressor 1 due to the effect of the throttling device or the arrangement of the closed port E. Similarly, when the port D communicates with the port E of the heating four-way valve 8, no refrigerant passes through the port C to flow into the intake port of the compressor 1 due to the effect of the throttling device or the arrangement of the closed port C, so as to ensure that there is no communication between the exhaust of compressor 1 and the intake of compressor.

The valve assembly includes a second four-way valve 10. A port S and a port E of the second four-way valve 10 are both in communication with the low-pressure gas pipe 5, a port C of the second four-way valve 10 is in communication with the one outdoor heat exchange unit 2, and a port D of the second four-way valve 10 is in communication with the high-pressure gas pipe 4.

The air conditioning system further includes a first four-way valve 9, a high-pressure valve 12, and a low-pressure valve 13. A port D of the first four-way valve 9 is in communication with the high-pressure gas pipe 4, a port S of the first four-way valve 9 is in communication with the low-pressure gas pipe 5, and a port C of the first four-way valve 9 is in communication with the end D of the second four-way valve 10 and the other outdoor heat exchange unit 2, respectively. The high-pressure valve 12 is disposed on the high-pressure gas pipe 4 and controls the on/off state of the high-pressure gas pipe 4. The low-pressure valve 13 has one port that is in communication with the high-pressure gas pipe 4, and another port that is in communication with the low-pressure gas pipe 5. The air conditioning system operates in different modes by controlling the communication states between the first four-way valve 9, the second four-way valve 10, the high-pressure valve 12 and the low-pressure valve 13.

In some embodiments, the high-pressure valve 12 is a solenoid valve or a two-way valve, and the low-pressure valve 13 is also a solenoid valve or a two-way valve.

An port E of the first four-way valve 9 is in communication with the intake port of the compressor 1 via a throttling device, or a port E of the first four-way valve 9 is arranged to be closed, so that the refrigerant cannot pass through the port E of the first four-way valve 9 to flow into the intake port of the compressor. A port E of the second four-way valve 10 is in communication with the intake port of the compressor 1 via a throttling device, or a port E of the second four-way valve 10 is arranged to be closed, so that the refrigerant cannot pass through the port E of the second four-way valve of 10 to flow into the intake port of the compressor, thereby ensuring that there is no communication between the exhaust of compressor 1 and the intake of compressor 1.

The air conditioning system includes heat exchangers 2001,2002. Some of the heat exchangers 2001 form the one outdoor heat exchange unit 2, and the remaining heat exchangers 2002 form the other outdoor heat exchange unit 2. The heat exchange areas of the two outdoor heat exchange units 2 and the requirements of the indoor unit 11 match.

Some heat exchange tubes at the lowest end of the heat exchanger form a defrosting heat exchanger 40. The defrosting heat exchanger 40 has one end 401 that is in communication with the exhaust port 102 of the compressor 1, and another end 402 that is in communication with the low-pressure gas pipe 5.

The air conditioning system further includes an IPM heat dissipation structure, and an inlet and an outlet of the IPM heat dissipation structure are both in communication with the liquid pipe 3.

The air conditioning system further includes a supercooling device 300. The supercooling device 300 is provided with a refrigerant channel 301 and a supercooling channel 302. Two ends of the refrigerant channel 301 are in communication with the liquid pipe 3. The supercooling channel 302 has one end 3021 that is in communication with the low-pressure gas pipe 5, and another end 3022 that is in communication with an inlet of the supercooling device 300 via a supercooling throttling device 3020. A portion of the liquid refrigerant enters the supercooling device 300 via the supercooling throttling device 3020 to supercool the refrigerant passing through the supercooling channel 302.

The air conditioning system further includes a liquid reservoir 200. The liquid reservoir 200 has a high-pressure inlet 201, a liquid inlet 202, and a gas outlet 203. The high-pressure inlet 201 is in communication with the high-pressure gas pipe 4. The liquid inlet 202 is in communication with the liquid pipe 3. The gas outlet 203 is in communication with the low-pressure gas pipe 5. Via the liquid reservoir 200, the system can store refrigerant or be supplemented with refrigerant.

The liquid reservoir further includes a pressure relief branch 204. The pressure relief branch 204 has one end that is in communication with the high-pressure inlet 201, and another end that is in communication with the low-pressure gas pipe 5 via a pressure relief throttling device 2041.

The low-pressure gas pipe 5 is in communication with a gas supplementing port 103 of the compressor 1. Part of the gaseous refrigerant enters the compressor 1 through the gas supplementing port 103 of the compressor 1.

Each outdoor heat exchange unit 2 is in communication with the liquid pipe 3 via an outdoor throttling device 30.

Figure 7:
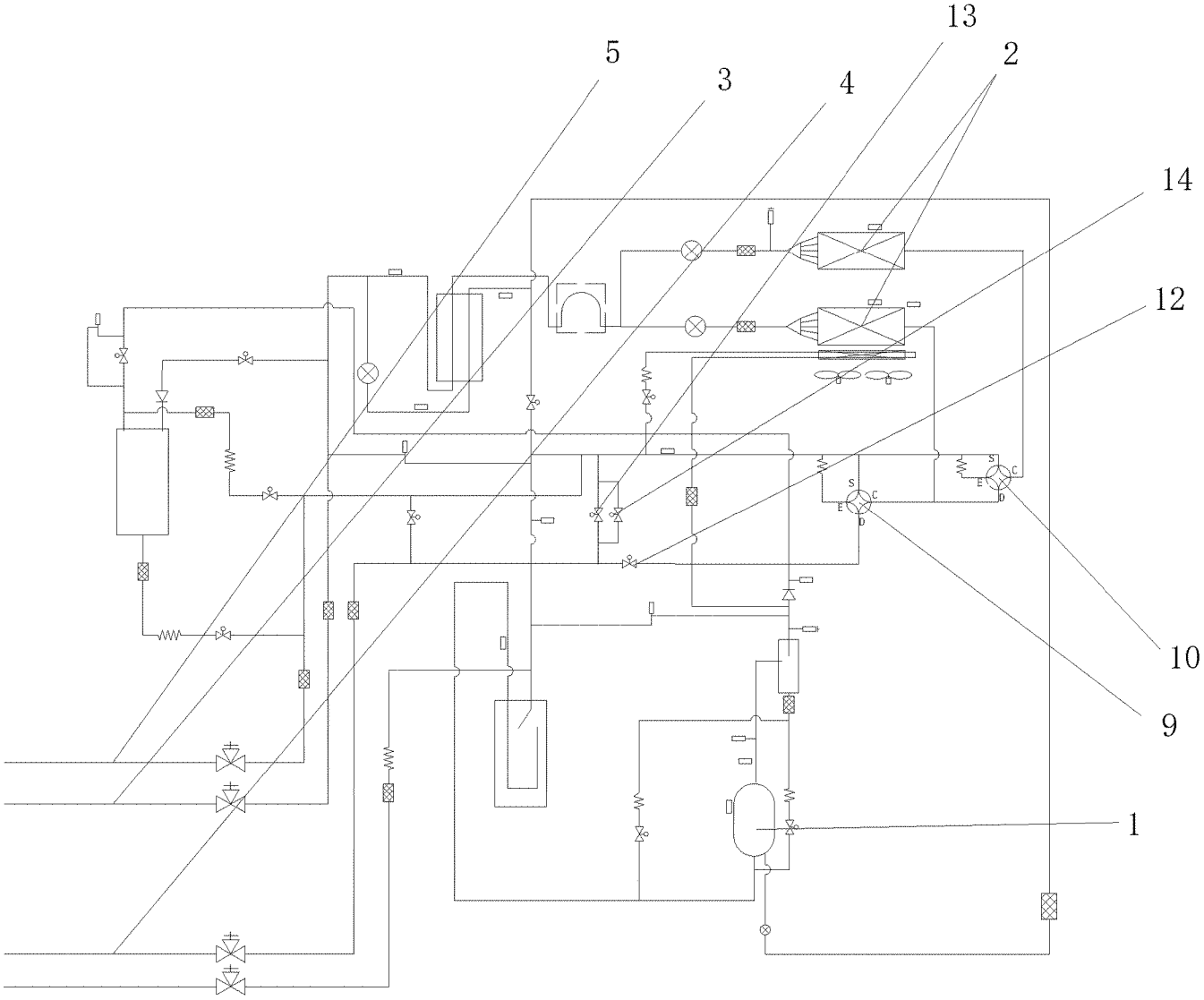
FIG. 7 is a structural schematic view showing another air conditioning system of the present disclosure.
Figure 8:
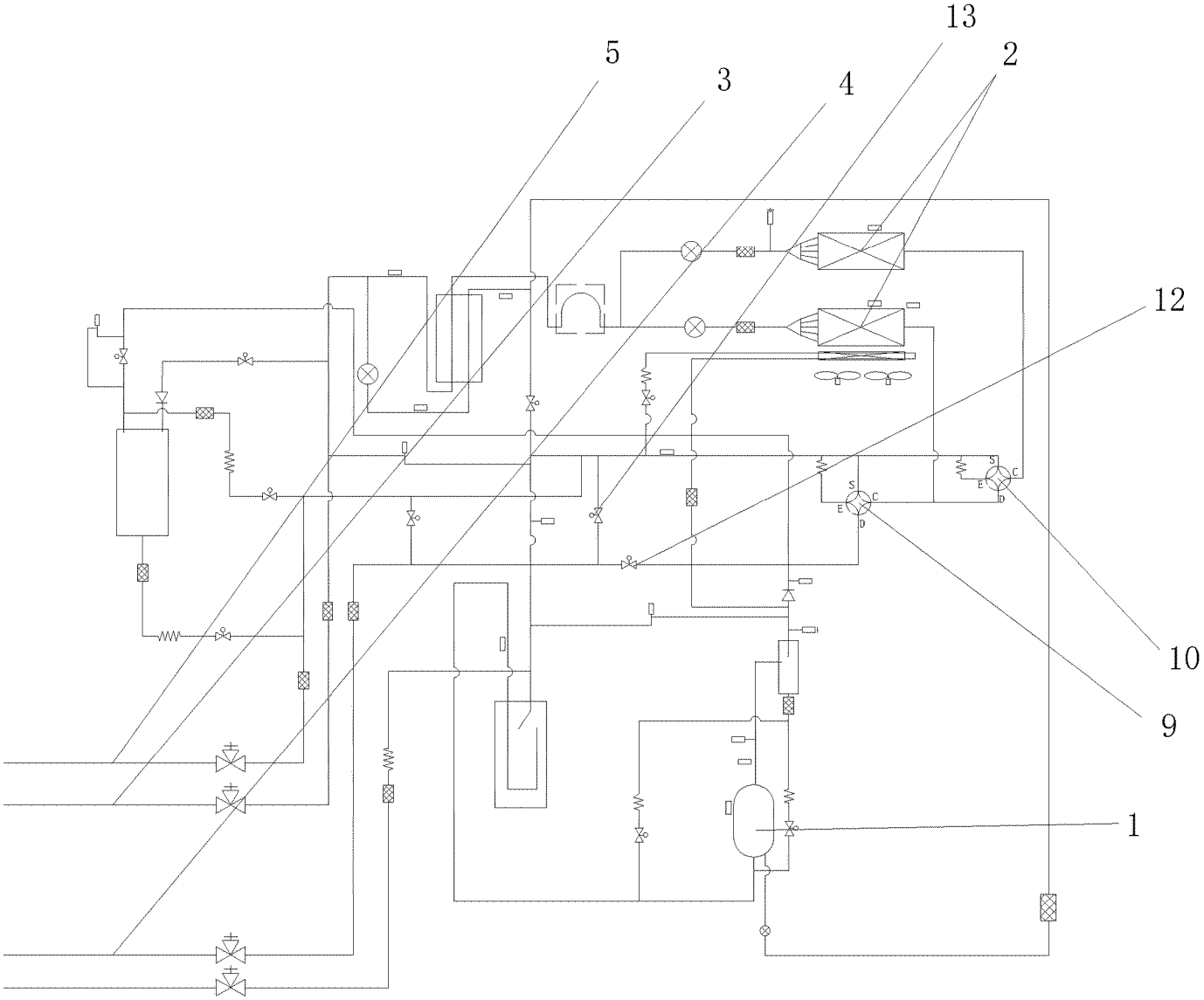
FIG. 8 is a structural schematic view showing another air conditioning system of the present disclosure.

An air conditioning system shown in FIGS. 7 and 8 includes a compressor 1, two outdoor heat exchange units 2, a first four-way valve 9, a second four-way valve 10, a liquid pipe 3, a high-pressure gas pipe 4, a low-pressure gas pipe 5, a high-pressure valve 12 and a low-pressure valve 13. The high-pressure gas pipe 4 is in communication with an exhaust port 102 of the compressor 1. The low-pressure gas pipe 5 is in communication with an intake port 101 of compressor 1. A port S of the second four-way valve 10 is in communication with the low-pressure gas pipe 5; a port C of the second four-way valve 10 is in communication with one outdoor heat exchange unit 2; and a port D of the second four-way valve 10 is in communication with the high-pressure gas pipe 4. A port D of the first four-way valve 9 is in communication with the high-pressure gas pipe 4; a port S of the first four-way valve 9 is in communication with the low-pressure gas pipe 5; and a port C of the first four-way valve 9 is in communication with the port D of the second four-way valve 10 and the other outdoor heat exchange unit 2, respectively. The high-pressure valve 12 is disposed on the high-pressure gas pipe 4. The low-pressure valve 13 has one port that is in communication with the high-pressure gas pipe 4, and another port that is in communication with the low-pressure gas pipe 5. The air conditioning system operates in different operating modes by controlling the communication states between the first four-way valve 9, the second four-way valve 10, the high-pressure valve 12 and the low-pressure valve 13.

A port E of the second four-way valve 10 is in communication with the intake port of the compressor 1 via a throttling device, or a port E of the second four-way valve 10 is arranged to be closed, so that the refrigerant cannot pass through the port E of the second four-way valve 10 to flow into the intake port of the compression. A port E of the first four-way valve 9 is in communication with the intake port of the compressor 1 via a throttling device, or a port E of the first four-way valve 9 is arranged to be closed, so that the refrigerant cannot pass through the port E of the first four-way valve 9 to flow into the intake port of the compressor.

The air conditioning system further includes a plurality of indoor units 11 that are provided in parallel. Each indoor unit 11 has a fifth state in which one end thereof is in communication with the liquid pipe 3 and the other end thereof is in communication with the high-pressure gas pipe 4, and has a sixth state in which one end thereof is in communication with the liquid pipe 3 and the other end thereof is in communication with the low-pressure gas pipe 5. Each outdoor heat exchange unit 2 is in communication with the liquid pipe 3 via an outdoor throttling device. The operating state of the indoor unit 11 is controlled by controlling the communication state between the indoor unit 11 and the corresponding liquid pipe 3 or the high-pressure gas pipe 4 or the low-pressure gas pipe 5.

The indoor unit 11 is in communication with the high-pressure gas pipe 4 via a first solenoid valve 111, and in communication with the low-pressure gas pipe 5 via a second solenoid valve 112.

A control method for the above air conditioning system includes flowing modes.

Figure 4:
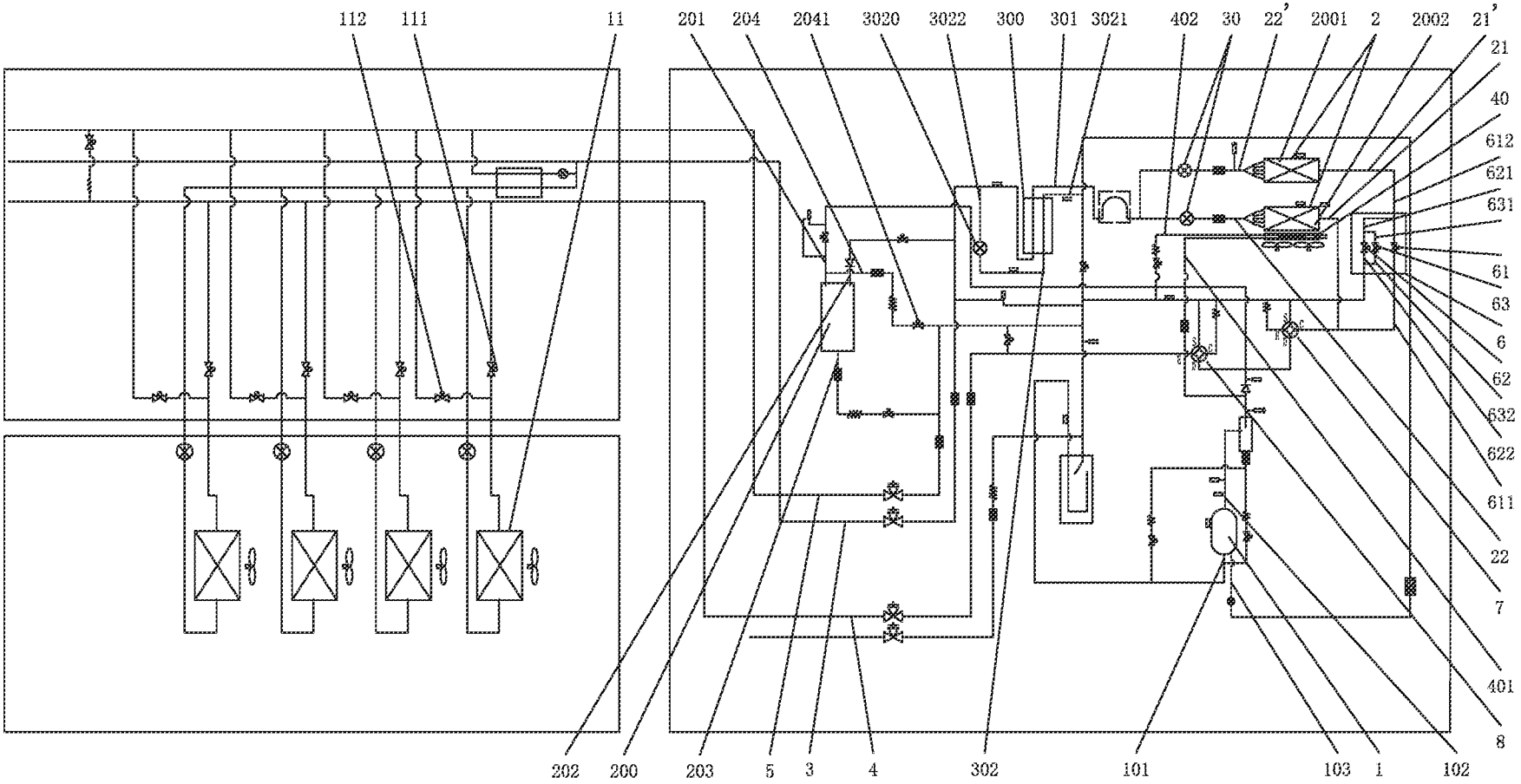
FIG. 4 is a structural schematic view showing another air conditioning system of the present disclosure.
Figure 4A:
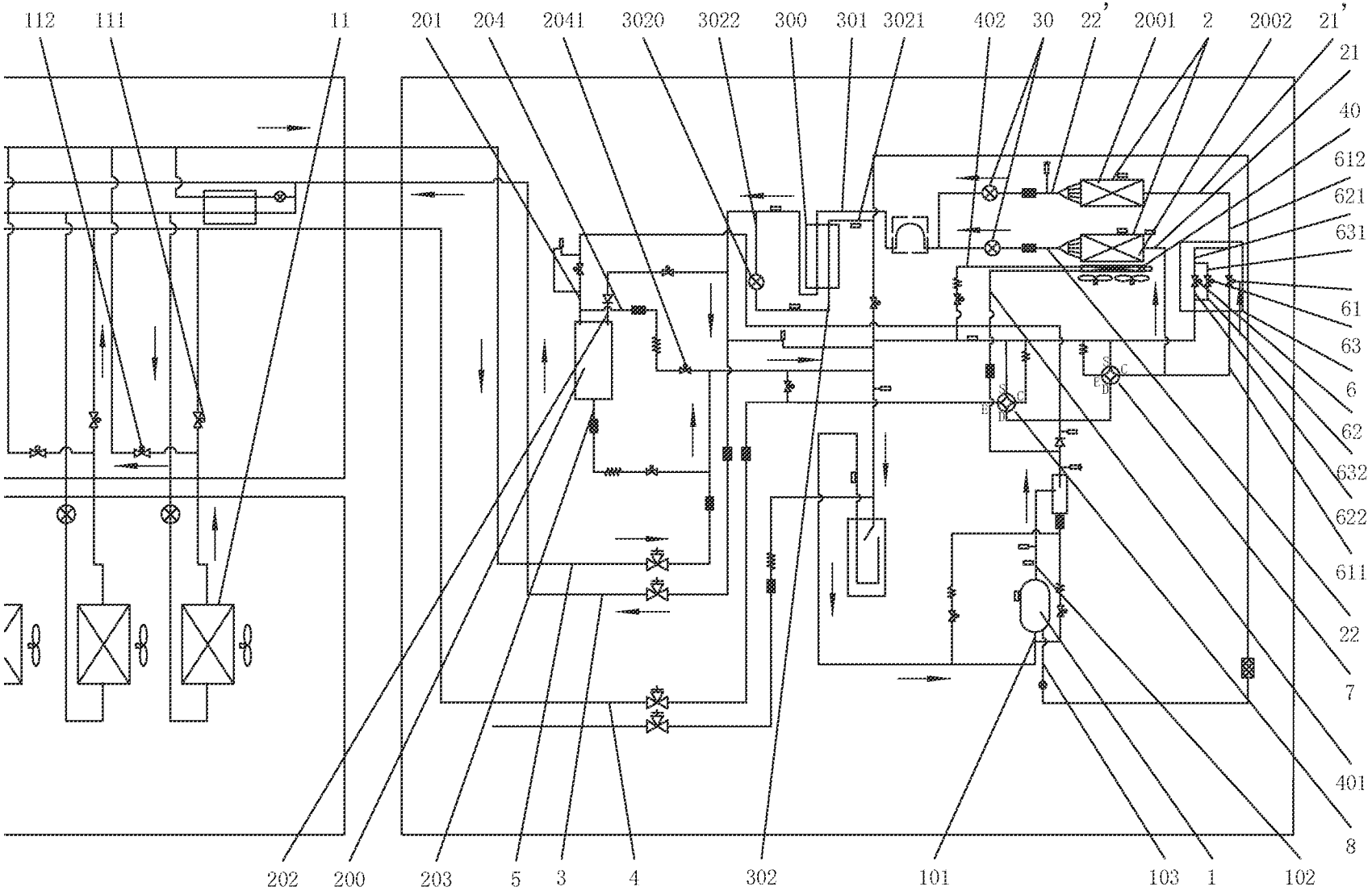
FIG. 4*a* is a structural schematic view showing a flow direction in a full cooling mode of the air conditioning system of FIG. 4.

A full cooling mode: as shown in FIG. 4*a*, the port D and the port C of the cooling four-way valve 7 communicate; the port D and the port E of the heating four-way valve 8 communicate; the high-pressure solenoid valve 61, the two outdoor throttling devices 30, and each second solenoid valve 112 are opened; the low-pressure solenoid valve 62 and each first solenoid valve 111 are closed; the exhaust gas from the compressor 1 flows through the outdoor heat exchange units 2, the liquid pipe 3, the indoor units 11 and the low-pressure gas pipe 5 sequentially, and follows back to the compressor 1.

Figure 4B:
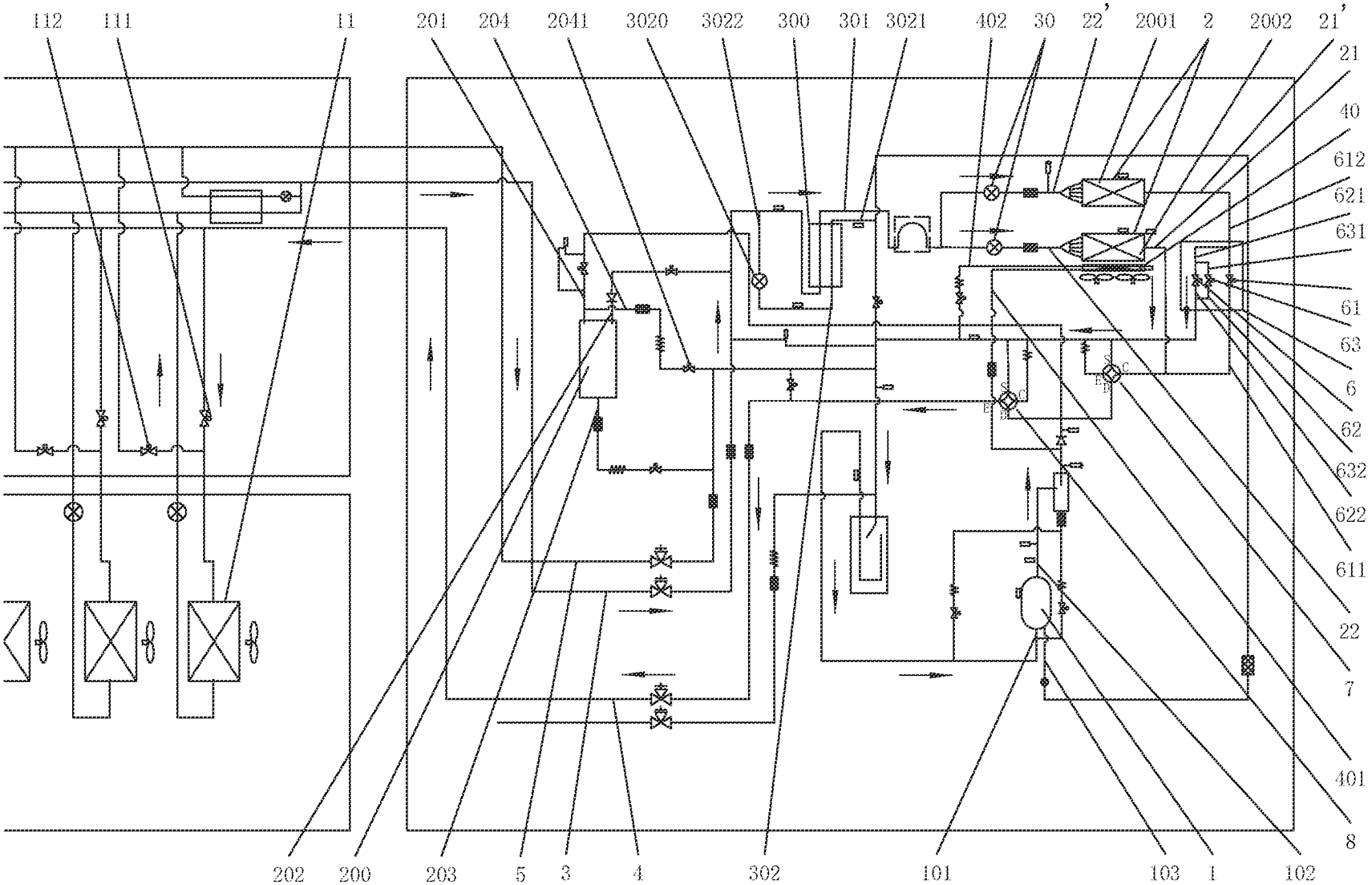
FIG. 4*b* is a structural schematic view showing a flow direction in a full heating mode of the air conditioning system of FIG. 4.

A full heating mode: as shown in FIG. 4*b*, the port D and the port E of the cooling four-way valve 7 communicate; the port D and the port E of the heating four-way valve 8 communicate; the high-pressure solenoid valve 61 and the each second solenoid valve 112 are closed; the low-pressure solenoid valve 62, the two outdoor throttling devices 30 and the each first solenoid valve 111 are opened; and the exhaust gas from the compressor 1 flows through the high-pressure gas pipe 4, the indoor units 11, the liquid pipe 3, the outdoor heat exchange units 2 sequentially, and flows back to the compressor 1.

Figure 4C:
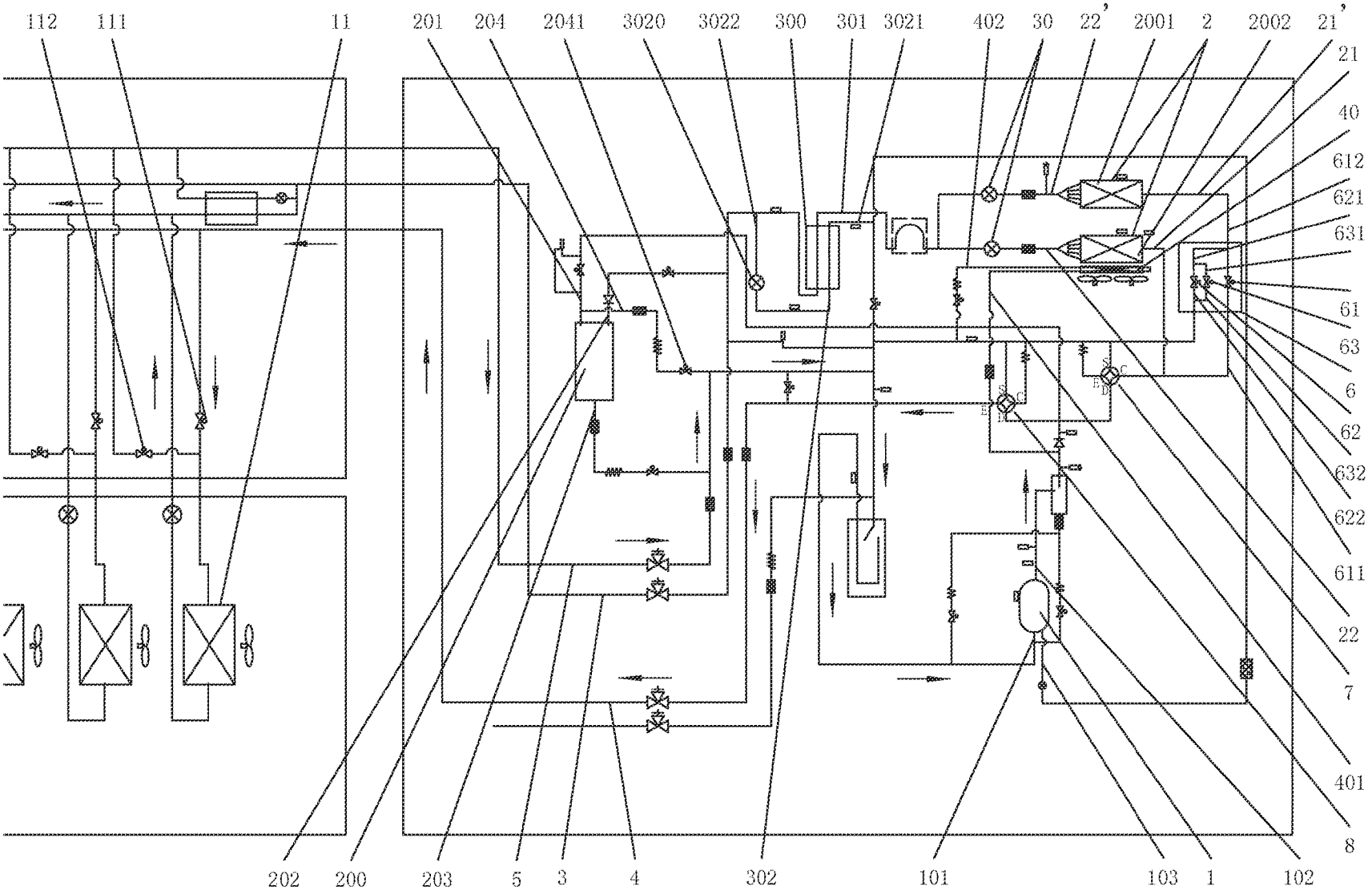
FIG. 4*c* is a structural schematic view showing a flow direction in a full heat recovery of the air conditioning system of FIG. 4.

A full heat recovery mode: as shown in FIG. 4*c*, the port D and the port E of the cooling four-way valve 7 communicate; the port D and the port E of the heating four-way valve 8 communicate; the high-pressure solenoid valve 61 and the two outdoor throttling devices are closed; the low-pressure solenoid valve 62 is opened; the first solenoid valve 111 of each of the indoor units 11 in a cooling mode is closed, and the second solenoid valve 112 thereof is opened; the first solenoid valve 111 of each of the indoor units 11 in a heating mode is opened, and the second solenoid valve 112 thereof is closed; the exhaust air from the compressor 1 flows through the high-pressure gas pipe 4, the indoor units 11 in the heating mode, the indoor units 11 in the cooling mode, and the low-pressure gas pipe 5 sequentially, and flows back to the compressor 1.

Figure 4D:
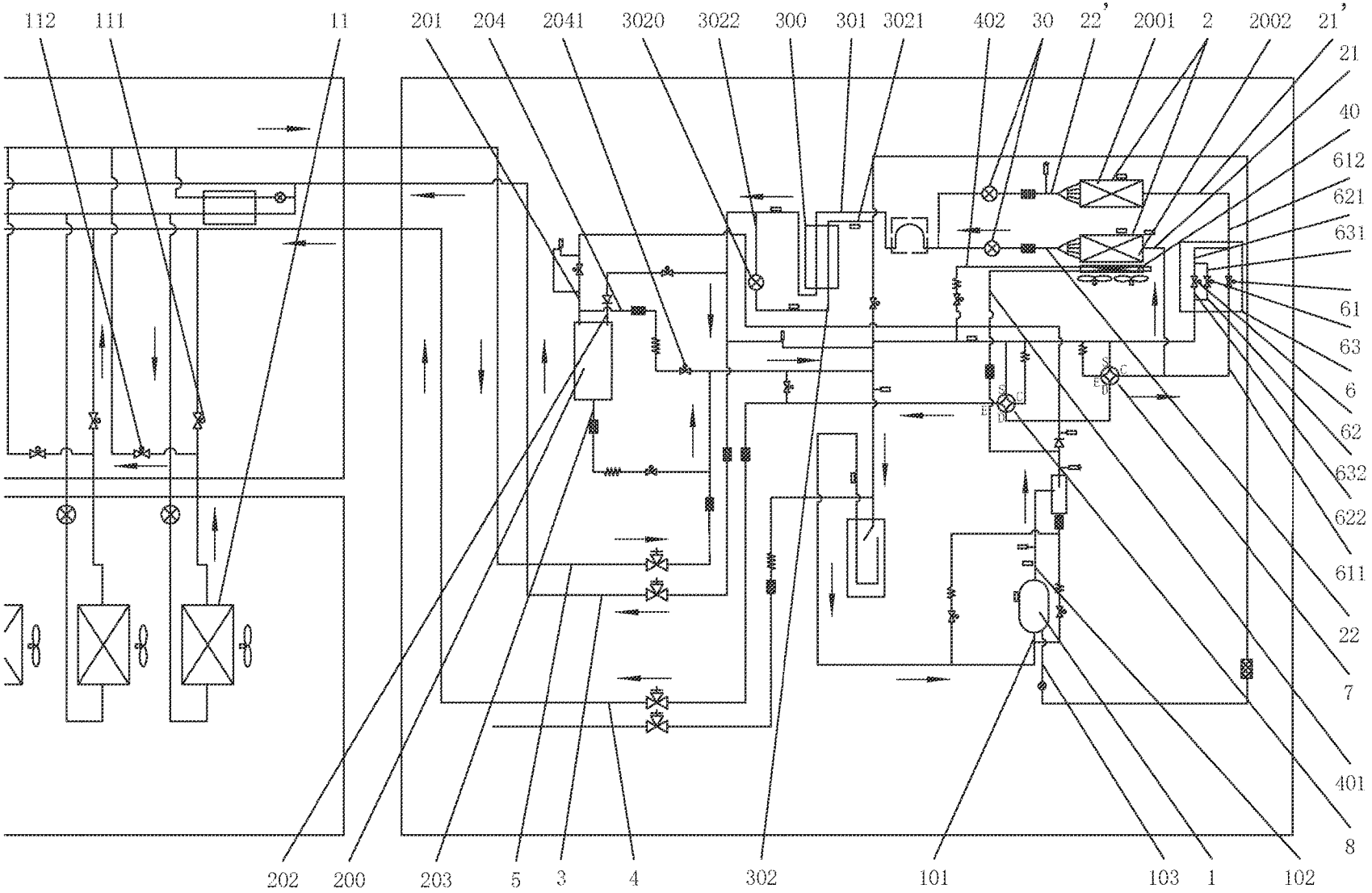
FIG. 4*d* is a structural schematic view showing a flow direction in a main cooling mode of the air conditioning system of FIG. 4.

A main cooling mode: as shown in FIG. 4*d*, the port D and the port C of the cooling four-way valve 7 communicate; the port D and the port E of the heating four-way valve 8 communicate; the low-pressure solenoid valve 62, and the outdoor throttling device of the outdoor heat exchange unit 2 that is in communication with the cooling four-way valve 7 are opened; the high-pressure solenoid valve 61 and the outdoor throttling device of the outdoor heat exchange unit 2 that is in communication with the high-pressure outlet are closed; the first solenoid valve 111 of each of the indoor units 11 in the cooling mode is closed, and the second solenoid valve 112 thereof is opened; the first solenoid valve 111 of each of the indoor units 11 in the heating mode is opened, and the second solenoid valve 112 thereof is closed; most of the exhaust gas from the compressor 1 flows through a first outdoor heat exchange unit 2, the liquid pipe 3, and the indoor units 11 in the cooling mode and the low-pressure gas pipe 5 sequentially, and flows back to the compressor 1; and the other portion of the exhaust gas from the compressor 1 flows through the high-pressure gas pipe 4, the indoor unit 11 in the heating mode, the liquid pipe 3, the indoor units 11 in the cooling mode and the low-pressure gas pipe 5 sequentially, and flows back to the compressor 1.

Figure 4E:
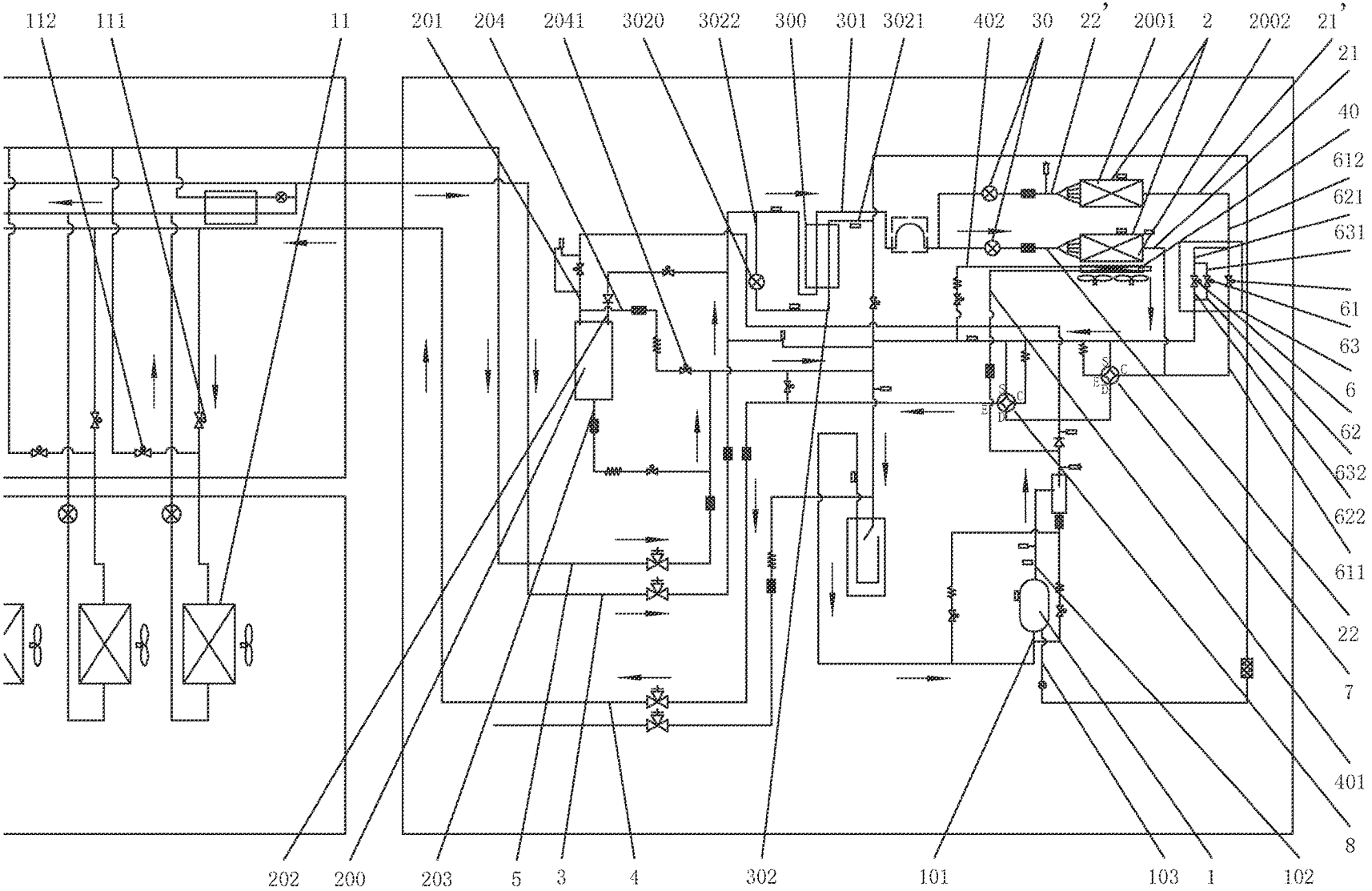
FIG. 4*e* is a structural schematic view showing a flow direction in a main heating mode of the air conditioning system of FIG. 4.
Figure 5:
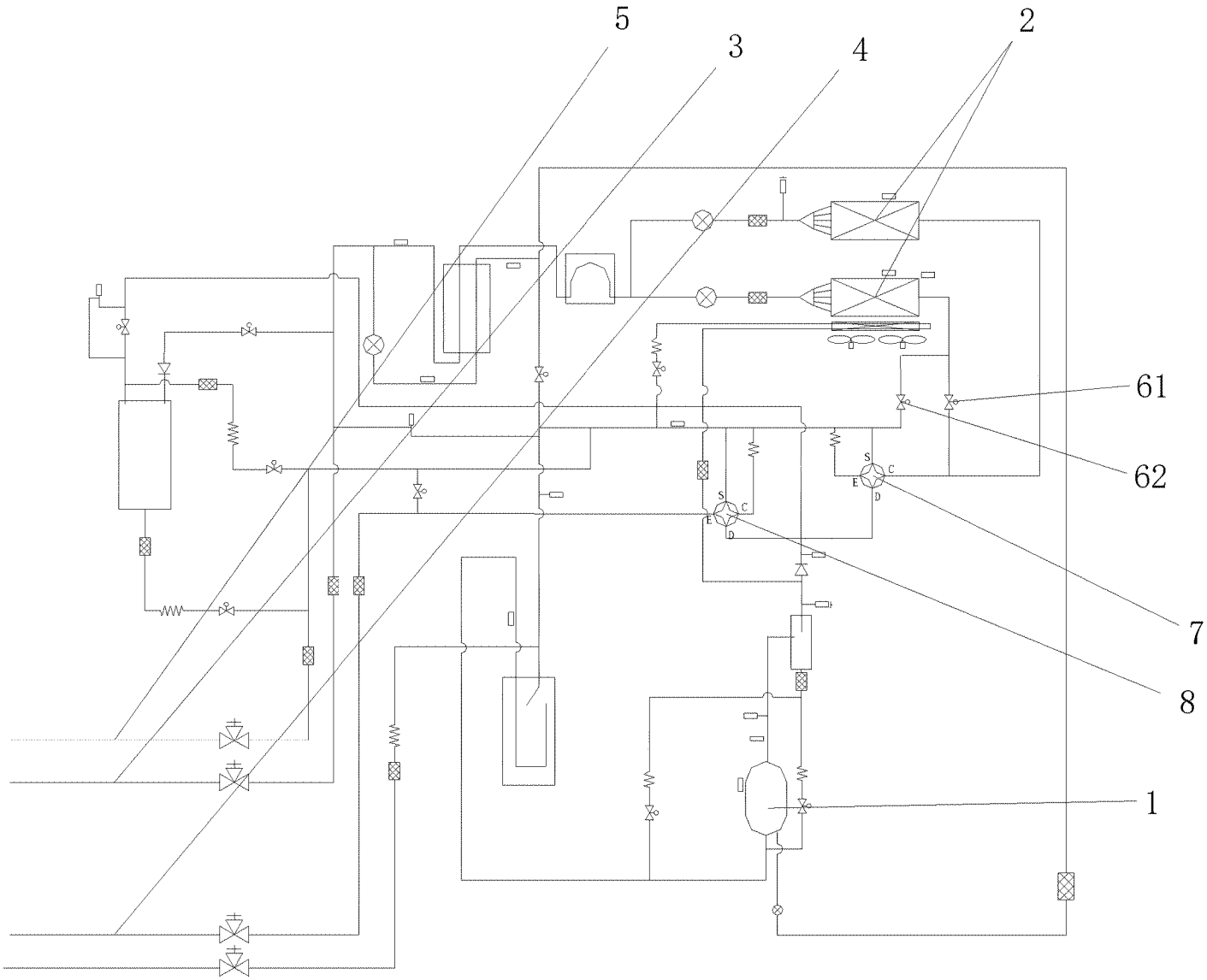
FIG. 5 is a structural schematic view showing another air conditioning system of the present disclosure.
Figure 6:
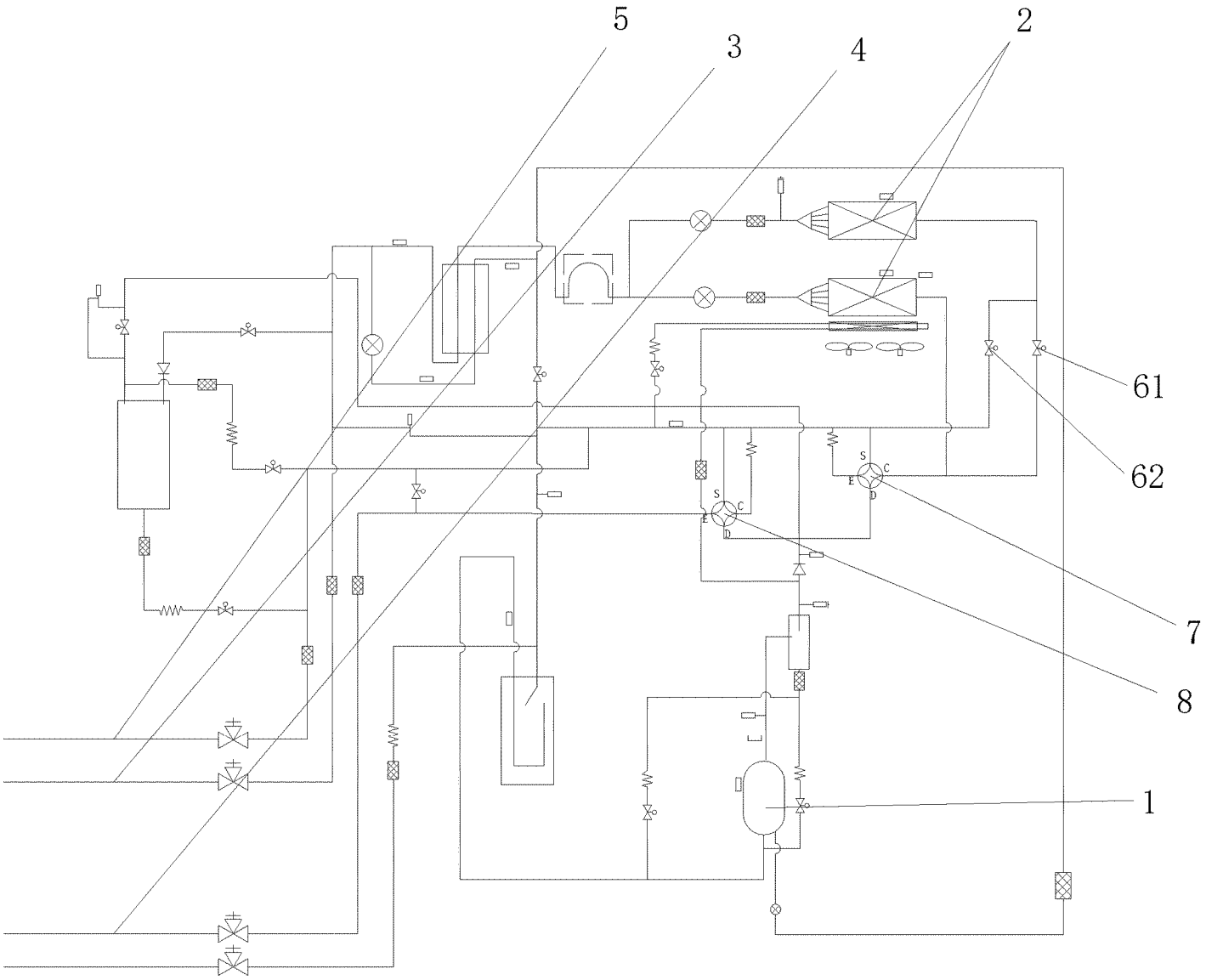
FIG. 6 is a structural schematic view showing another air conditioning system of the present disclosure.

A main heating mode: as shown in FIG. 4*e*, the port D and the port E of the cooling four-way valve 7 communicate; the port D and the port E of the heating four-way valve 8 communicate; the high-pressure solenoid valve 61, and the outdoor throttling device of the one outdoor heat exchange unit 2 that is in communication with the high-pressure outlet, are closed; the low-pressure solenoid valve 62, and the outdoor throttling device of the other outdoor heat exchange unit 2 that is in communication with the cooling four-way valve 7, are opened; the first solenoid valve 111 of each of the indoor units 11 in the cooling mode is closed, and the second solenoid valve 112 thereof is opened; the first solenoid valve 111 of each of the indoor units 11 in the heating mode is opened, and the second solenoid valve 112 thereof is closed; the exhaust gas from the compressor 1 enters the indoor units 11 in the heating mode through the high-pressure gas pipe 4 and is condensed; after being condensed, a portion of the exhaust gas from the compressor 1 flows through the indoor units 11 in the cooling mode and the low-pressure gas pipe 5 sequentially, and flows back to the compressor 1; and after being condensed, another portion of the exhaust air from the compressor 1 flows through the liquid pipe 3, the first outdoor heat exchange unit 2 sequentially, and flows back to the compressor 1.

The air-conditioning system includes a low-pressure bypass solenoid valve 63. In the full cooling mode, the full heating mode, the full heat recovery mode, the main cooling mode, or the main heating mode, the on/off state of the low-pressure bypass solenoid valve 63 is the same as that of the low-pressure solenoid valve 62.

The outdoor heat exchange unit 2 that is in communication with the high-pressure outlet is an auxiliary heat exchanger, and the control method further includes:

switching the auxiliary heat exchanger from a cooling state to a non-operating state: after a first time period t1 from a time when a switching command is received, the high-pressure solenoid valve 61 is closed; after a time period t2 from a time when the high-pressure solenoid valve 61 is closed, the outdoor throttling device of the auxiliary heat exchanger is closed; after a time period t3 from a time when the outdoor throttling device is closed, the low-pressure bypass solenoid valve 63 is opened; after a time period t4 from a time when the low-pressure bypass solenoid valve 63 is opened, the low-pressure solenoid valve 62 is opened;

switching the auxiliary heat exchanger from the non-operating state to the cooling state: after a time period t5 from a time when a switching command is received, the low-pressure bypass solenoid valve 63 and the low-pressure solenoid valve 62 are closed; after a time period t6 from a time when the low-pressure solenoid valve 62 is closed, the outdoor throttling device of the auxiliary heat exchanger is opened to the maximum opening; after a time t7 from a time when the outdoor throttling device is opened to the maximum opening, the high-pressure solenoid valve 61 is opened;

switching the auxiliary heat exchanger from the heating state to the non-operating state: after an time period t8 from a time when a switching command is received, the outdoor throttling device of the auxiliary heat exchanger is closed;

switching the auxiliary heat exchanger from the non-operating state to the heating state: after a time period t9 from a time when a switching command is received, the outdoor throttling device of the auxiliary heat exchanger is opened to the maximum opening;

switching the auxiliary heat exchanger from the cooling state to the heating state: after the time period t1 from the time when the switching command is received, the high-pressure solenoid valve 61 is closed; after the time period t2 from the time when the high-pressure solenoid valve 61 is closed, the outdoor throttling device of the auxiliary heat exchanger is closed; after the time period t3 from the time when the outdoor throttling device is closed, the low-pressure bypass solenoid valve 63 is opened; after the time period t4 from the time when the low-pressure bypass solenoid valve 63 is opened, the low-pressure solenoid valve 62 is opened; after the time period t9 from the time when the low-pressure solenoid valve 62 is opened, the outdoor throttling device of the auxiliary heat exchanger is opened to the maximum opening;

switching the auxiliary heat exchanger from the heating state to the cooling state: after the eighth time period t8 from the time when a switching command is received, the outdoor throttling device of the auxiliary heat exchanger is closed; after the time period t5 from the time when the outdoor throttling device is closed, the low-pressure bypass solenoid valve 63 and the low-pressure solenoid valve 62 are closed; after the time period t6 from the time when the low-pressure solenoid valve 62 is closed, the outdoor throttling device of the auxiliary heat exchanger is opened to the maximum opening; after the time period t7 from the time when the outdoor throttling device is opened to the maximum opening, the high-pressure solenoid valve 61 is opened.

A control method for the aforementioned air conditioning system includes following modes.

In a full cooling mode: the port D and the port C of the first four-way valve 9 communicate, the port D and the port C of the second four-way valve 10 communicate; the high-pressure valve 12, the two outdoor throttling devices, and the second solenoid valve 112 are opened; the low-pressure valve 13 and the first solenoid valve 111 are closed; most of the exhaust gas from the compressor 1 flows through the two outdoor heat exchange units 2, the liquid pipe 3, the indoor unit 11 and the low-pressure gas pipe 5 sequentially, and flows back to the compressor 1; a small portion of the exhaust air from compressor 1 enters the indoor unit 11 through the high-pressure gas pipe 4.

In a full heating mode: the port D and the port E of the first four-way valve 9 communicate; the port D and the port E of the second four-way valve 10 communicate; the high-pressure valve 12, the first solenoid valve 111, and the two outdoor throttling devices are opened; the low-pressure valve 13 and the second solenoid valve 112 are closed; the exhaust gas from the compressor 1 flows through the high-pressure gas pipe 4, the indoor unit 11, the liquid pipe 3, the outdoor heat exchange unit 2 and the low-pressure gas pipe 5 sequentially, and flows back to the compressor 1.

In a full heat recovery mode: the port D and the port E of the first four-way valve 9 communicate; the port D and the port E of the second four-way valve 10 communicate; the high-pressure valve 12 is opened; the low-pressure valve 13 and the two outdoor throttling devices are closed; the first solenoid valve 111 of the indoor unit 11 in the cooling mode is closed, and the second solenoid valve 112 thereof is opened; the first solenoid valve 111 of the indoor unit 11 in the heating mode is opened, and the second solenoid valve 112 is closed; the exhaust gas from the compressor 1 flows through the high-pressure gas pipe 4, the indoor unit 11 in the heating mode, the indoor unit 11 in the cooling mode, and the low-pressure gas pipe 5 sequentially, and flows back to the compressor 1.

In a main cooling mode: the port D and the port C of the first four-way valve 9 communicate; the port D and the port C of the second four-way valve 10 communicate; the high-pressure valve 12 and the two outdoor throttling devices are opened; the low-pressure valve 13 is closed; the first solenoid valve 111 of the indoor unit 11 in the cooling mode is closed, and the second solenoid valve 112 thereof is opened; the first solenoid valve 111 of the indoor unit 11 in the heating mode is opened, and the second solenoid valve 112 is closed; most of the exhaust gas from the compressor 1 flows through the outdoor heat exchange units 2, the liquid pipe 3, the indoor unit 11 in the cooling mode, and the low-pressure gas pipe 5 sequentially, and flows back to the compressor 1; a small portion of the exhaust gas from the compressor 1 flows through the high-pressure gas pipe 4, the indoor unit 11 in the heating mode, the liquid pipe, the indoor unit 11 in the cooling mode, and the low-pressure gas pipe 5 sequentially, and flows back to the compressor 1. Alternatively, in a main cooling mode: the port D and the port C of the first four-way valve 9 communicate, and the port D and the port C of the second four-way valve 10 communicate; the high-pressure valve 12 and one outdoor throttling device are opened, and the other outdoor throttling device and the low-pressure valve 13 are closed; the first solenoid valve 111 of the indoor unit 11 in the cooling mode is closed, and the second solenoid valve 112 thereof is opened; the first solenoid valve 111 of the indoor unit 11 in the heating mode is opened, and the second solenoid valve 112 is closed; most of the exhaust gas from the compressor 1 flows through the outdoor heat exchange units 2, the liquid pipe 3, the indoor unit 11 in the cooling mode, and the low-pressure gas pipe 5 sequentially, and flows back to the compressor 1; the other portion of the exhaust gas from the compressor 1 flows through the high-pressure gas pipe 4, the indoor unit 11 in the heating mode, the liquid pipe 3, the indoor unit 11 in the cooling mode, and the low-pressure gas pipe 5 sequentially, and flows back to the compressor 1.

In a main heating mode: the port D and the port E of the first four-way valve 9 communicate; the port D and the port E of the second four-way valve 10 communicate; the high-pressure valve 12 and the two outdoor throttling devices are opened; the low-pressure valve 13 is closed; the first solenoid valve 111 of the indoor unit 11 in the cooling mode is closed, and the second solenoid valve 112 thereof is opened; the first solenoid valve 111 of the indoor unit 11 in the heating mode is opened, and the second solenoid valve 112 is closed; the exhaust gas from the compressor 1 enters the indoor unit 11 in the heating mode through the high-pressure gas pipe 4 to be condensed; after being condensed, a portion of the exhaust gas from the compressor 1 flows through the indoor unit 11 in the cooling mode and the low-pressure gas pipe 5 sequentially, and flows back to the compressor 1; after being condensed, the other portion of the exhaust gas from compressor 1 flows through the liquid pipe 3, the two outdoor heat exchange units 2 and the low-pressure gas pipe 5 sequentially, and flows back to the compressor 1. Alternatively, in a main heating mode: the port D and the port E of the first four-way valve 9 communicate; the port D and the port E of the second four-way valve 10 communicate; the high-pressure valve 12 and one outdoor throttling device are opened; the other outdoor throttling device and the low-pressure valve 13 are closed; the first solenoid valve 111 of the indoor unit 11 in the cooling mode is closed, and the second solenoid valve 112 thereof is opened; the first solenoid valve 111 of the indoor unit 11 in the heating mode is opened, and the second solenoid valve 112 thereof is closed; the exhaust gas from the compressor 1 enters the indoor unit 11 in the heating mode through the high-pressure gas pipe 4 to be condensed; after being condensed, a portion of the exhaust gas from the compressor 1 flows through the indoor unit 11 in the cooling mode and the low-pressure gas pipe 5 sequentially, and flows back to the compressor 1; and after being condensed, the other portion of the exhaust gas from the compressor 1 flows through the liquid pipe 3, the outdoor heat exchange unit 2 in the on state, and the low-pressure gas pipe 5 sequentially, and flows back to the compressor 1.

The air conditioning system includes a low-pressure bypass valve 14. In the full cooling mode, the full heating mode, the full heat recovery mode, the main cooling mode, or the main heating mode, the on/off state of the low-pressure bypass valve 14 is the same as that of the low-pressure valve 13.

Moreover, using two outdoor heat exchange units 2 can achieve following effects.

In the main cooling mode, and under low temperature cooling operating conditions:

The outdoor temperature is relatively low, and the heat exchange temperature difference is relatively large. Known to the inventors, after being condensed, the refrigerant enters the cooling indoor unit, and the temperature of the refrigerant is low. After the refrigerant returns to the compressor 1, the high pressure and the low pressure of the entire system are both relatively low, and the cooling effect of the cooling indoor unit is better. However, as the high pressure of the heating indoor unit is relatively low, the air outlet temperature of the heating indoor unit is relatively low, and there is no heating effect, which is easy to be complained by customers. However, in some embodiments, the heat exchanger is arranged to be two portions, so that under these operating conditions, only the main heat exchanger is controlled to operate, which greatly reduces the cooling capacity to be absorbed by the outside, increase the high pressure of the air conditioning system, and moreover, the quantity of flow of the refrigerant entering the heating indoor unit is increased, thereby greatly increasing the heating effect of the heating indoor unit.

In the main heating mode, and under high temperature operating conditions:

The outdoor environment temperature is relatively high, and the evaporation temperature difference is relatively large. Known to the inventors, the outdoor heat exchange unit 2 can absorb a large amount of heat from the outside environment. Such heat makes the high pressure and the low pressure of the system increase, so that the air outlet temperature of the heating indoor unit is relatively high, but the air outlet temperature of the cooling indoor unit is also relatively high, and thus there is no cooling effect. However, double heat exchangers are arranged, so that in these operating conditions, only the main heat exchanger operates, which reduces the heat absorption from the outside, and the amount of refrigerant entering the cooling indoor unit is increased, thereby enhancing the cooling effect.

What described above are several embodiments of the present disclosure, and they are specific and in details, but not intended to limit the scope of the present disclosure. It will be understood by those skilled in the art that various modifications and improvements can be made without departing from the conception of the present disclosure, and these modifications and improvements are within the scope of the present disclosure. Therefore, the protection scope of the present disclosure should be subject to the appended claims.

What is claimed is:

1. An air conditioning system, comprising a compressor, two outdoor heat exchange units, a liquid pipe, a high-pressure gas pipe being in communication with an exhaust port of the compressor, a low-pressure gas pipe being in communication with an intake port of the compressor, and a valve assembly;

wherein one outdoor heat exchange unit has a first state; in the first state, one end of the one outdoor heat exchange unit is in communication with the high-pressure gas pipe, and another end thereof is in communication with the liquid pipe;

the one outdoor heat exchange unit has a second state; in the second state, the one end of the one outdoor heat exchange unit is in communication with the low-pressure gas pipe, and the other end thereof is in communication with the liquid pipe;

another outdoor heat exchange unit has a third state; in the third state, one end of the other outdoor heat exchange unit is in communication with the liquid pipe, and another end thereof is in communication with the high-pressure gas pipe via the valve assembly;

the other outdoor heat exchange unit has a fourth state; in the fourth state, the one end of the outdoor heat exchange unit is in communication with the liquid pipe, and the other end thereof is in communication with the low-pressure gas pipe via the valve assembly;

the valve assembly controls the outdoor heat exchange unit to switch between the third state and the fourth state;

the valve assembly comprises a high-pressure solenoid valve and a low-pressure solenoid valve;

the high-pressure solenoid valve has one end that forms a high-pressure inlet of the valve assembly, and another end that forms a high-pressure outlet of the valve assembly;

the low-pressure solenoid valve has one end being in communication with the high-pressure outlet, and another end that forms a low-pressure outlet of the valve assembly;

the high-pressure inlet is directly or indirectly in communication with the exhaust port of the compressor; the high-pressure outlet is in communication with the corresponding outdoor heat exchange unit; and the low-pressure outlet is in communication with the low-pressure gas pipe;

the air conditioning system further comprises a cooling four-way valve; a port D of the cooling four-way valve is in communication with the exhaust port of the compressor, a port S of the cooling four-way valve is in communication with the low-pressure gas pipe, a port C of the cooling four-way valve is in communication with the one outdoor heat exchange unit and the high-pressure inlet, respectively; the high-pressure outlet is in communication with the other outdoor heat exchange unit and a port E of the cooling four-way valve is in communication with the intake port of the compressor via a throttling device, or a port E of the cooling four-way valve is arranged to be closed.

2. The air conditioning system according to claim 1, wherein the valve assembly further comprises a low-pressure bypass solenoid valve; the low-pressure bypass solenoid valve has one end being in communication with the high-pressure outlet, and another end being in communication with the low-pressure outlet.

3. The air conditioning system according to claim 1, wherein the valve assembly comprises a second four-way valve; a port S of the second four-way valve is in communication with the low-pressure gas pipe, a port C of the second four-way valve is in communication with the one outdoor heat exchange unit, and a port D of the second four-way valve is in communication with the high-pressure gas pipe.

4. The air conditioning system according to claim 3, wherein the air conditioning system further comprises a first four-way valve, a high-pressure valve, and a low-pressure valve;

a port D of the first four-way valve is in communication with the high-pressure gas pipe, a port S of the first four-way valve is in communication with the low-pressure gas pipe, a port C of the first four-way valve is in communication with the port D of the second four-way valve and the other outdoor heat exchange unit, respectively;

the high-pressure valve is disposed on the high-pressure gas pipe; and the low-pressure valve has one end being in communication with the high-pressure gas pipe, and another end being in communication with the low-pressure gas pipe.

5. The air conditioning system according to claim 4, wherein a port E of the second four-way valve is in communication with the intake port of the compressor via a throttling device, or a port E of the second four-way valve is arranged to be closed; and a port E of the first four-way valve is in communication with the intake port of the compressor via a throttling device, or a port E of the first four-way valve is arranged to be closed.

6. The air conditioning system according to claim 1, wherein the high-pressure inlet and the high-pressure outlet are both in communication with the high-pressure gas pipe, and the low-pressure outlet is in communication with the lower-pressure gas pipe.

7. The air conditioning system according to claim 1, wherein the air conditioning system further comprises a supercooling device; the supercooling device is provided with a refrigerant channel and a supercooling channel; two ends of the refrigerant channel are in communication with the liquid pipe; the supercooling channel has one end being in communication with the low-pressure gas pipe, and another end being in communication with an inlet of the supercooling device via a supercooling throttling device; a portion of liquid refrigerant enters the supercooling device through the supercooling throttling device, supercooling refrigerant passing through the supercooling channel.

8. The air conditioning system according to claim 1, wherein the air conditioning system further comprises a liquid reservoir; the liquid reservoir is provided with a high-pressure inlet, a liquid inlet, and a gas outlet; the high-pressure inlet is in communication with the high-pressure gas pipe; the liquid inlet is in communication with the liquid pipe; and the gas outlet is in communication with the low-pressure gas pipe;

the liquid reservoir further comprises a pressure relief branch; the pressure relief branch has one end being in communication with the high-pressure inlet, and another end being in communication with the low-pressure gas pipe via a pressure relief throttling device.

9. The air conditioning system according to claim 1, wherein the air conditioning system further comprises an Intelligent Power Module (IPM) heat dissipation structure, and an inlet and an outlet of the IPM heat dissipation structure are both in communication with the liquid pipe.

10. The air conditioning system according to claim 1, wherein the low-pressure gas pipe is in communication with a gas supplementing port of the compressor, and a portion of gaseous refrigerant enters the compressor from the gas supplementing port of the compressor.

11. The air conditioning system according to claim 1, wherein each outdoor heat exchange unit is in communication with the liquid pipe via an outdoor throttling device.

12. An air conditioning system, comprising a compressor, two outdoor heat exchange units, a liquid pipe, a high-pressure gas pipe being in communication with an exhaust port of the compressor, a low-pressure gas pipe being in communication with an intake port of the compressor, and a valve assembly;

wherein one outdoor heat exchange unit has a first state; in the first state, one end of the one outdoor heat exchange unit is in communication with the high-pressure gas pipe, and another end thereof is in communication with the liquid pipe;

the one outdoor heat exchange unit has a second state; in the second state, the one end of the one outdoor heat exchange unit is in communication with the low-pressure gas pipe, and the other end thereof is in communication with the liquid pipe;

another outdoor heat exchange unit has a third state; in the third state, one end of the other outdoor heat exchange unit is in communication with the liquid pipe, and another end thereof is in communication with the high-pressure gas pipe via the valve assembly;

the other outdoor heat exchange unit has a fourth state; in the fourth state, the one end of the outdoor heat exchange unit is in communication with the liquid pipe, and the other end thereof is in communication with the low-pressure gas pipe via the valve assembly;

the valve assembly controls the outdoor heat exchange unit to switch between the third state and the fourth state;

the air conditioning system further comprises a plurality of indoor units provided in parallel;

each indoor unit has a fifth state; in the fifth state, one end of the indoor unit is in communication with the liquid pipe, and another end thereof is in communication with the high-pressure gas pipe;

each indoor unit has a sixth state; in the sixth state, the one end of the indoor unit is in communication with the liquid pipe, and the other end thereof is in communication with the low-pressure gas pipe;

each outdoor heat exchange unit is in communication with the liquid pipe via an outdoor throttling device;

the air conditioning system further comprises a cooling four-way valve; a port D of the cooling four-way valve is in communication with the exhaust port of the compressor, a port S of the cooling four-way valve is in communication with the low-pressure gas pipe, a port C of the cooling four-way valve is in communication with the one outdoor heat exchange unit and the high-pressure inlet, respectively; the high-pressure outlet is in communication with the other outdoor heat exchange unit and a port E of the cooling four-way valve is in communication with the intake port of the compressor via a throttling device, or a port E of the cooling four-way valve is arranged to be closed;

each indoor unit is in communication with the high-pressure gas pipe via a first solenoid valve, and in communication with the low-pressure gas pipe via a second solenoid valve.

13. A control method for the air conditioning system according to claim 12, comprising a full cooling mode, in which: a port D and a port C of a cooling four-way valve communicate; a port D and a port E of a heating four-way valve communicate; a high-pressure solenoid valve, two outdoor throttling devices, and the second solenoid valve are opened; the low-pressure solenoid valve and the first solenoid valve are closed; most of exhaust gas from the compressor flows through the outdoor heat exchange units, the liquid pipe, the indoor units, and the low-pressure gas pipe sequentially, and flows back to the compressor; and a small portion of the exhaust gas from the compressor enters the indoor units via the high-pressure gas pipe;

a full heating mode, in which: the port D and a port E of the cooling four-way valve communicate; the port D and the port E of the heating four-way valve communicate; the high-pressure solenoid valve and the each second solenoid valve are closed; the low-pressure solenoid valve, the two outdoor throttling devices, and the each first solenoid valve are opened; and the exhaust gas from the compressor flows through the high-pressure gas pipe, the indoor units, the liquid pipe, the outdoor heat exchange units and the low-pressure gas pipe sequentially, and flows back to the compressor;

a full heat recovery mode, in which: the port D and the port E of the cooling four-way valve communicate; the port D and the port E of the heating four-way valve communicate; the high-pressure solenoid valve and the two outdoor throttling devices are closed; the low-pressure solenoid valve is opened; the first solenoid valve of each of the indoor units in a cooling mode is closed, and the second solenoid valve thereof is opened; the first solenoid valve of each of the indoor units in a heating mode is opened, and the second solenoid valve thereof is closed; the exhaust gas from the compressor flows through the high-pressure gas pipe, the indoor units in the heating mode, the indoor units in the cooling mode, and the low-pressure gas pipe sequentially, and flows back to the compressor;

a main cooling mode, in which: the port D and the port C of the cooling four-way valve communicate; the port D and the port E of the heating four-way valve communicate; the low-pressure solenoid valve, and the outdoor throttling device of the outdoor heat exchange unit that is in communication with the cooling four-way valve are opened; the high-pressure solenoid valve and the outdoor throttling device of the outdoor heat exchange unit that is in communication with the high-pressure outlet are closed; the first solenoid valve of each of the indoor units in the cooling mode is closed, and the second solenoid valve thereof is opened; the first solenoid valve of each of the indoor units in the heating mode is opened, and the second solenoid valve thereof is closed; most of the exhaust gas from the compressor flows through a first outdoor heat exchange unit, the liquid pipe, and the indoor units in the cooling mode, and the low-pressure gas pipe sequentially, and flows back to the compressor; and another portion of the exhaust gas from the compressor flows through the high-pressure gas pipe, the indoor units in the heating mode, the liquid pipe, the indoor unit in the cooling mode, and the low-pressure gas pipe sequentially, and flows back to the compressor;

a main heating mode, in which: the port D and the port E of the cooling four-way valve communicate; the port D and the port E of the heating four-way valve communicate; the high-pressure solenoid valve, and the outdoor throttling device of the outdoor heat exchange unit that is in communication with the high-pressure outlet, are closed; the low-pressure solenoid valve, and the outdoor throttling device of the second outdoor heat exchange unit that is in communication with the cooling four-way valve, are opened; the first solenoid valve of each of the indoor units in the cooling mode is closed, and the second solenoid valve thereof is opened; the first solenoid valve of each of the indoor units in the heating mode is opened, and the second solenoid valve thereof is closed; the exhaust gas from the compressor enters the indoor units in the heating mode via the high-pressure gas pipe and is condensed; after being condensed, a portion of the exhaust gas from the compressor flows through the indoor unit in the cooling mode and the low-pressure gas pipe sequentially, and flows back to the compressor; after being condensed, another portion of the condensed exhaust gas from the compressor flows through the liquid pipe, the first outdoor heat exchange unit and the low-pressure gas pipe sequentially, and flows back to the compressor.

14. The control method for the air conditioning system according to claim 13, wherein the air-conditioning system comprises a low-pressure bypass solenoid valve; in the full cooling mode, the full heating mode, the full heat recovery mode, the main cooling mode, or the main heating mode, an on/off state of the low-pressure bypass solenoid valve is a same as an on/off state of the low-pressure solenoid valve.

15. The control method for the air conditioning system according to claim 14, wherein the outdoor heat exchange unit that is in communication with the high-pressure outlet is an auxiliary heat exchanger, and the control method further comprises:

switching the auxiliary heat exchanger from a cooling state to a non-operating state, comprising: after a time period t1 from a time when a switching command is received elapses, the high-pressure solenoid valve being closed; after a time period t2 from a time when the high-pressure solenoid valve is closed elapses, the outdoor throttling device of the auxiliary heat exchanger being closed; after a time period t3 from a time when the outdoor throttling device is closed elapses, the low-pressure bypass solenoid valve being opened; after a time period t4 from a time when the low-pressure bypass solenoid valve is opened elapses, the low-pressure solenoid valve being opened;

switching the auxiliary heat exchanger from the non-operating state to the cooling state, comprising: after a time period t5 from a time when a switching command is received elapses, the low-pressure bypass solenoid valve and the low-pressure solenoid valve being closed; after a time period t6 from a time when the low-pressure solenoid valve is closed elapses, the outdoor throttling device of the auxiliary heat exchanger being opened to a maximum opening; after a time t7 from a time when the outdoor throttling device is opened to the maximum opening elapses, the high-pressure solenoid valve being opened;

switching the auxiliary heat exchanger from the heating state to the non-operating state, comprising: after a time period t8 from a time when a switching command is received elapses, the outdoor throttling device of the auxiliary heat exchanger is closed;

switching the auxiliary heat exchanger from the non-operating state to the heating state, comprising: after a time period t9 from a time when a switching command is received elapses, the outdoor throttling device of the auxiliary heat exchanger being opened to the maximum opening;

switching the auxiliary heat exchanger from the cooling state to the heating state, comprising: after the time period t1 from the time when the switching command is received elapses, the high-pressure solenoid valve being closed; after the time period t2 from the time when the high-pressure solenoid valve is closed elapses, the outdoor throttling device of the auxiliary heat exchanger being closed; after the time period t3 from the time when the outdoor throttling device is closed elapses, the low-pressure bypass solenoid valve being opened; after the time period t4 from the time when the low-pressure bypass solenoid valve is opened elapses, the low-pressure solenoid valve being opened; after the time period t9 from the time when the low-pressure solenoid valve is opened elapses, the outdoor throttling device of the auxiliary heat exchanger being opened to the maximum opening;

switching the auxiliary heat exchanger from the heating state to the cooling state: after the eighth time period t8 from the time when a switching command is received elapses, the outdoor throttling device of the auxiliary heat exchanger is closed; after the time period t5 from the time when the outdoor throttling device is closed elapses, the low-pressure bypass solenoid valve and the low-pressure solenoid valve are closed; after the time period t6 from the time when the low-pressure solenoid valve is closed elapses, the outdoor throttling device of the auxiliary heat exchanger is opened to the maximum opening; after the time period t7 from the time when the outdoor throttling device is opened to the maximum opening elapses, the high-pressure solenoid valve is opened.

16. An air conditioning system, comprising a compressor, two outdoor heat exchange units, a liquid pipe, a high-pressure gas pipe being in communication with an exhaust port of the compressor, a low-pressure gas pipe being in communication with an intake port of the compressor, and a valve assembly;

wherein one outdoor heat exchange unit has a first state; in the first state, one end of the one outdoor heat exchange unit is in communication with the high-pressure gas pipe, and another end thereof is in communication with the liquid pipe;

the one outdoor heat exchange unit has a second state; in the second state, the one end of the one outdoor heat exchange unit is in communication with the low-pressure gas pipe, and the other end thereof is in communication with the liquid pipe;

another outdoor heat exchange unit has a third state; in the third state, one end of the other outdoor heat exchange unit is in communication with the liquid pipe, and another end thereof is in communication with the high-pressure gas pipe via the valve assembly;

the other outdoor heat exchange unit has a fourth state; in the fourth state, the one end of the outdoor heat exchange unit is in communication with the liquid pipe, and the other end thereof is in communication with the low-pressure gas pipe via the valve assembly;

the valve assembly controls the outdoor heat exchange unit to switch between the third state and the fourth state; and the air conditioning system comprises heat exchangers; some of the heat exchangers form the one outdoor heat exchange unit; remaining heat exchangers form the other outdoor heat exchange unit; some heat exchange tubes at a lowest end of each heat exchanger form a defrosting heat exchanger; the defrosting heat exchanger has one end being in communication with the exhaust port of the compressor, and another end being in communication with the low-pressure gas pipe;

the air conditioning system further comprises a cooling four-way valve; a port D of the cooling four-way valve is in communication with the exhaust port of the compressor, a port S of the cooling four-way valve is in communication with the low-pressure gas pipe, a port C of the cooling four-way valve is in communication with the one outdoor heat exchange unit and the high-pressure inlet, respectively; the high-pressure outlet is in communication with the other outdoor heat exchange unit and a port E of the cooling four-way valve is in communication with the intake port of the compressor via a throttling device, or a port E of the cooling four-way valve is arranged to be closed.

17. A control method for the air conditioning system according to claim 12, comprising:

a full cooling mode, in which: a port D and a port C of the first four-way valve communicate, a port D and a port C of the second four-way valve communicate; a high-pressure valve, two outdoor throttling devices, and each second solenoid valve are opened; a low-pressure valve and each first solenoid valve are closed;

a full heating mode, in which: the port D and the port E of the first four-way valve communicate; the port D and the port E of the second four-way valve communicate; the high-pressure valve, each first solenoid valve, and the two outdoor throttling devices are opened; the low-pressure valve and each second solenoid valve are closed;

a full heat recovery mode, in which: the port D and the port E of the first four-way valve communicate; the port D and the port E of the second four-way valve communicate; the high-pressure valve is opened; the low-pressure valve and the two outdoor throttling devices are closed; the first solenoid valve of each of the indoor units in a cooling mode is closed, and the second solenoid valve thereof is opened; the first solenoid valve of each of the indoor units in a heating mode is opened, and the second solenoid valve thereof is closed;

a main cooling mode, in which: the port D and the port C of the first four-way valve communicate; the port D and the port C of the second four-way valve communicate; the high-pressure valve and the two outdoor throttling devices are opened; the low-pressure valve is closed; the first solenoid valve of each of the indoor units in the cooling mode is closed, and the second solenoid valve thereof is opened; the first solenoid valve of each of the indoor units in the heating mode is opened, and the second solenoid valve thereof is closed; or in which: the port D and the port C of the first four-way valve communicate, and the port D and the port C of the second four-way valve communicate; the high-pressure valve and one outdoor throttling device are opened, and another outdoor throttling device and the low-pressure valve are closed; the first solenoid valve of each of the indoor units in the cooling mode is closed, and the second solenoid valve thereof is opened; the first solenoid valve of each of the indoor units in the heating mode is opened, and the second solenoid valve thereof is closed;

a main heating mode, in which: the port D and the port E of the first four-way valve communicate; the port D and the port E of the second four-way valve communicate; the high-pressure valve and the two outdoor throttling devices are opened; the low-pressure valve is closed; the first solenoid valve of each of the indoor units in the cooling mode is closed, and the second solenoid valve thereof is opened; the first solenoid valve of each of the indoor units in the heating mode is opened, and the second solenoid valve thereof is closed; or in which: the port D and the port E of the first four-way valve communicate; the port D and the port E of the second four-way valve communicate; the high-pressure valve and the one outdoor throttling device are opened; the other outdoor throttling device and the low-pressure valve are closed; the first solenoid valve of each of the indoor units in the cooling mode is closed, and the second solenoid valve thereof is opened; the first solenoid valve of each of the indoor units in the heating mode is opened, and the second solenoid valve thereof is closed.

* * * * *